US012390061B2

(12) United States Patent
Laundre

(10) Patent No.: US 12,390,061 B2
(45) Date of Patent: Aug. 19, 2025

(54) FLEXIBLE TOILET SEAT

(71) Applicant: Kohler Co., Kohler, WI (US)

(72) Inventor: Jeffrey T. Laundre, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 40 days.

(21) Appl. No.: 18/116,062

(22) Filed: Mar. 1, 2023

(65) Prior Publication Data

US 2023/0284844 A1 Sep. 14, 2023

Related U.S. Application Data

(60) Provisional application No. 63/319,534, filed on Mar. 14, 2022.

(51) Int. Cl.
*A47K 13/24* (2006.01)

(52) U.S. Cl.
CPC ..... *A47K 13/24* (2013.01)

(58) Field of Classification Search
CPC ..... A47K 13/24; A47K 13/02
See application file for complete search history.

(56) References Cited

U.S. PATENT DOCUMENTS

| | | | | |
|---|---|---|---|---|
| 3,772,111 | A | 11/1973 | Ginsburg | |
| 3,863,277 | A | 2/1975 | Harrison | |
| 4,248,646 | A * | 2/1981 | Ginsburg | A47K 13/02 297/DIG. 2 |
| 8,312,571 | B2 * | 11/2012 | Vierkant, III | A47K 13/02 4/237 |
| 9,756,995 | B2 | 9/2017 | Bryant | |
| 11,253,116 | B2 | 2/2022 | Hand et al. | |
| 2011/0004987 | A1 * | 1/2011 | Deng | A47K 13/305 4/229 |

FOREIGN PATENT DOCUMENTS

| | | | |
|---|---|---|---|
| CN | 206551920 | U | 10/2017 |
| CN | 109805818 | A | 5/2019 |
| CN | 212797338 | U | 3/2021 |
| GB | 1200840 | A | 8/1970 |
| GB | 1304306 | A | 1/1973 |
| JP | 2013022105 | A | 2/2013 |

OTHER PUBLICATIONS

Chinese Office Action from Chinese Patent Application No. 202310267011.5, dated Jun. 5, 2025, 15 pages. (including English summary).

* cited by examiner

*Primary Examiner* — Christine J Skubinna
(74) *Attorney, Agent, or Firm* — Lempia Summerfield Katz LLC

(57) ABSTRACT

A toilet seat includes a seat including a top surface, a bottom surface opposite the top surface, an inner edge where the top surface and the bottom surface meet, an outer surface connecting an outer perimeter of the top surface and an outer perimeter of the bottom surface, and a cavity in the outer surface extending toward the inner edge. The toilet seat further includes a cushion disposed in the cavity. The top surface and the cushion may be configured to deform elastically and vertically in response to a load applied to the top surface.

16 Claims, 33 Drawing Sheets

FLEXIBLE TOILET SEAT

This application claims priority benefit of Provisional Application No. 63/319,534 filed Mar. 14, 2022, which is hereby incorporated by reference in its entirety.

FIELD

The present application relates generally to the field of seats for toilets. More specifically, the present disclosure relates to toilet seats including a cushion configured to deform user-specifically, thereby improving user comfort.

BACKGROUND

Toilet seats are often designed for high volume usage and to accommodate users of all shapes and sizes. User comfort is often sacrificed in favor of a high durability, universal toilet seat. Accordingly, there is a need for a more comfortable toilet seat that provides user customizability.

BRIEF DESCRIPTION OF THE DRAWINGS

Exemplary embodiments are described herein with reference to the following drawings, according to an exemplary embodiment.

FIG. 1 illustrates a toilet including a tank and FIG. 2 illustrates a tankless toilet according to exemplary embodiments of the present disclosure.

The foregoing and other features of the present disclosure will become apparent from the following description and appended claims, taken in conjunction with the accompanying drawings. Understanding that these drawings depict only several embodiments in accordance with the disclosure and are therefore, not to be considered limiting of its scope, the disclosure will be described with additional specificity and detail through use of the accompanying drawings.

DETAILED DESCRIPTION

Described herein are toilet seat assemblies (i.e., toilet seats) including a cushion disposed within a cavity in the seat. The toilet seat assembly (i.e., seat and cushion) are configured to deform elastically and vertically when a user sits on the toilet seat. The cushion may control deformation of the seat and be removably coupled to the seat. Accordingly, the cushions may be interchangeable allowing a user to select a cushion, and hence a deformation, based on their preference. In some examples, a cushion may provide multiple stage deformation providing a wide spectrum of deformation and improving comfort for users of various shapes, sizes, and weights. In some examples, the cushion 300 further includes a fastening and locking loop for easily coupling the cushion 300 to the seat 200.

Figure 1:
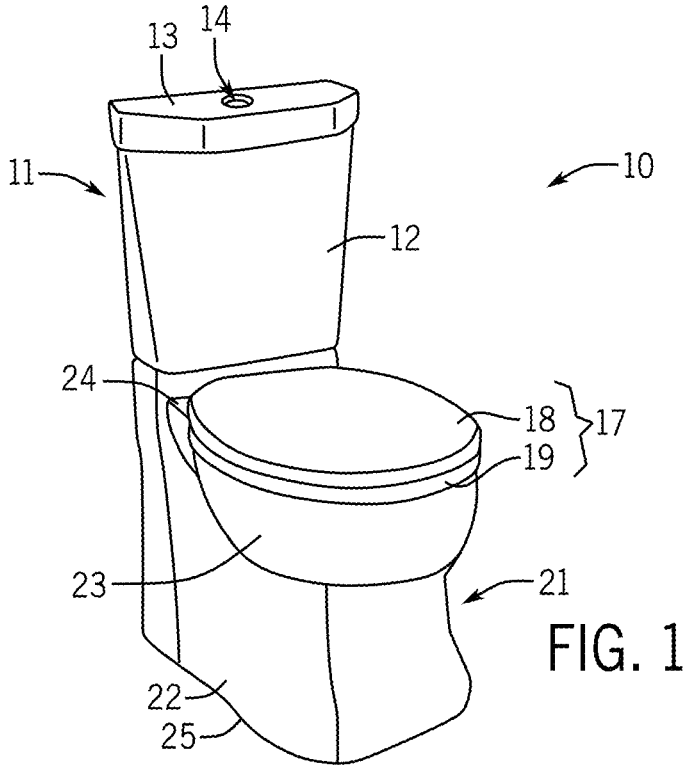
FIGS. 1 and 2 illustrate perspective views of exemplary embodiments of toilets according to the present disclosure. Specifically.
Figure 2:
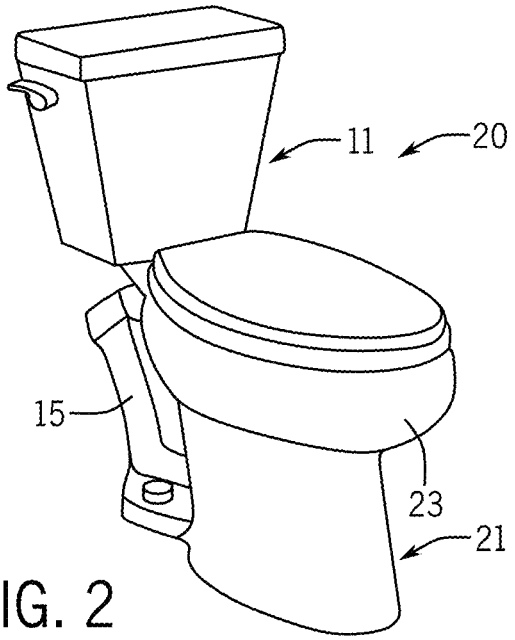

FIGS. 1 and 2 illustrate toilets according to an exemplary embodiment of the present disclosure. FIG. 1 illustrates an exemplary embodiment of a skirted toilet 10 that includes a tank 11, a pedestal 21 (or base), a seat assembly 17 and a coupling or mounting assembly. The tank 11 may include a reservoir 12 for storing the water used during operational (or flushing) cycles, a lid (or cover) 13 for providing selective access into the reservoir 12, and an actuator 14 that is configured to initiate an operational cycle when activated. The actuator 14 or flush mechanism may be a button configured to activate when depressed (or pulled) a predetermined distance or when touched, a lever configured to activate when rotated a predetermined angular travel, or any suitable device configured to activate based upon an input manipulation by a user.

It should be noted that the shapes and configurations of the tank, pedestal, seat assembly, and the internal components (including the trapway and other features) may vary from the embodiments shown and described herein, and that the embodiments disclosed herein are not intended as limitations. It should be noted that various components of the toilet may be made of vitreous china. It should be noted that various components of the toilet may be polymeric and/or over molded or otherwise fixed to the toilet. It should be noted, for example, that although the exemplary embodiment of the toilet 10 is shown configured with the tank 11 formed separately from the pedestal 21 and later coupled to the pedestal, the tank may be integrally formed with the pedestal as a one-piece design. In other words, the toilet may be a one-piece design, a two-piece design, or have any suitable configuration. The toilet disclosed herein may have a wide variety of skirted toilet configurations, and all such configurations are intended to be encompassed herein. The following description of various toilet features is therefore intended as illustration only of one possible embodiment, and it should be understood by those reviewing the present description that similar concepts or features may be included in various other embodiments.

The tank 11 may include an inlet opening configured to receive water from a coupled water supply, such as from a hose (e.g., line, tube). The tank 11 may also include an inlet valve assembly or other device configured to control the flow of water from the water supply into the tank through the inlet opening. Within the tank 11 may be provided a float device for controlling the inlet valve assembly, such as by opening the valve to refill the reservoir 12 of the tank 11 after an operational cycle and closing the valve when the water in the reservoir 12 reaches a preset volume or height. The tank 11 may also include an outlet opening configured to transfer (e.g., conduct) the water stored in the reservoir 12 of the tank to the pedestal 21 upon activation of the actuator 14. The pedestal 21 may include toilet bowl 23. The tank 11 may include an outlet valve assembly or other device configured to control the flow of water from the tank into the pedestal 21 through the outlet opening.

The pedestal 21 (or base) of the toilet 10 may include a wall 22 having any suitable shape that is configured to form a bowl 23 having an opening formed by an upper rim at the top of the opening. The pedestal 21 may also be configured to include a plurality of walls having varying shapes that together form a bowl having an opening formed by a rim. The wall 22 of the pedestal may extend downward and/or rearward from the bowl 23 to form a lower portion 25 configured to support the pedestal 21 and the toilet 10. The lower portion 25 may be formed by the end (e.g., lower rim) of the wall 22, or may include a member that extends generally in a horizontal plane from one or more than one end of the wall. The pedestal 21 may also include a top member 24 that extends between two sides of the wall 22 (or between two opposing walls) and is provided rearward (or behind) the bowl 23, wherein the top member 24 forms a plateau for supporting the tank 11, such as the bottom surface of the reservoir 12 of the tank 11. The top member 24 may include an inlet opening that may be aligned with the outlet opening of the tank 11, such as when the tank 11 is coupled to (or resting above) the pedestal 21, wherein water is selectively transferred (e.g., conducted) from the tank 11 through the outlet opening of the tank to the pedestal 21 through the inlet opening of the pedestal 21, when the toilet is activated through the actuator 14. The outlet valve assembly may control the flow of water from the tank to the pedestal. The toilet may also include a gasket or seal that is provided between the tank 11 and the pedestal 21 to prohibit leaking. For example, a gasket may be provided between the outlet opening of the tank and the inlet opening of the pedestal to prohibit leaking between the tank and the pedestal.

The plateau formed by the top member 24 of the pedestal 21 may also provide for coupling of the seat assembly 17 to the pedestal 21 of the toilet 10. For example, the top member 24 may include one or more than one opening, wherein each opening is configured to receive a fastening device (e.g., bolt, screw, etc.) to couple (e.g., attach) the seat assembly 17 to the top member 24 of the pedestal 21. As another example, the top member 24 may include one or more than one fastening device (e.g., bolts, recessed nuts, etc.) integrally formed therein (i.e., already provided connected or coupled to the pedestal 21), wherein the fastening device may be used to couple or secure at least a portion of the seat assembly 17 to the pedestal 21.

The bowl 23 of the pedestal 21 may be configured to include a receptacle (e.g., sump) and an outlet opening, wherein the water and waste is collected in the receptacle until being removed through the outlet opening, such as upon activation of the actuator 14. The pedestal 21 may also include a pedestal internal passageway, such as a trapway, that connects the outlet opening or discharge outlet of the bowl 23 to a drain or soil pipe. The passageway, or trapway, generally includes a first portion, a second portion, and a weir separating the first and second portions. The first portion of the passageway may extend from the outlet opening of the bowl 23 at an upwardly oblique angle to the weir. The second portion of the passageway may extend from the weir downwardly to the exiting device, such as the drain or soil pipe.

Between operational cycles (e.g., flush cycles) of the toilet 10, the water (and waste) is collected in the first portion of the trapway (in addition to the receptacle of the bowl), such that the weir prohibits the water from passing past the weir and into the second portion of the trapway. A flushing cycle may begin upon activation of the actuator 14. Upon activation of the actuator, additional water (e.g., fresh water and or grey water) may be discharged into the bowl 23 of the pedestal 21, resulting in the flushing action and waste removal through the soil pipe. The flushing cycle may include generation of a siphon to assist the flushing action and waste removal.

The seat assembly 17 may include a cover member 18 (e.g., lid), a seat member 19 (e.g., ring member), and a hinge. The seat member 19 may be configured to include an annular member that encircles an opening, wherein the annular member provides a seating surface for the user of the toilet 10. The seat member 19 may also be pivotally coupled (e.g., attached) to the hinge, wherein the seat member may rotate (or pivot) about the hinge, such as between a first lowered or seated position and a second raised or upright position. The cover member 18 may be configured to be round, oval, or any other suitable shape. Typically, the profile or shape of the outer surface of the cover member will be configured to match (i.e., to be substantially similar) to the profile of the outer surface of the seat member to improve the aesthetics of the seat assembly and toilet. The cover member 18 may also be coupled to the hinge, wherein the cover member may rotate (or pivot) about the hinge, such as between a first down lowered or down position and a second raised or upright position. The cover member 18 may be provided above the seat member in the down position to thereby cover the opening of the seat member 19, as well as to conceal the inside of the bowl 23 of the pedestal 21. The cover member 18 may be configured to rest against the outside surface of the tank 11, when the cover member 18 is in the upright position, such that the cover member 18 remains in the upright position in order for a user to sit upon the seat member 19.

FIG. 2 illustrates a non-skirted toilet 20 according to another exemplary embodiment of the present disclosure. The internal components, including the trapway 15, are visible in the pedestal 21 of non-skirted toilet 20. It should be noted that the devices, methods, and systems described herein may include and/or be used with both skirted and non-skirted toilets. It should further be noted that devices, methods, and systems described herein may include or be used with both toilets including tanks and tankless toilets. A waterline may supply a tankless toilet with water during a flush cycle.

Figure 3:
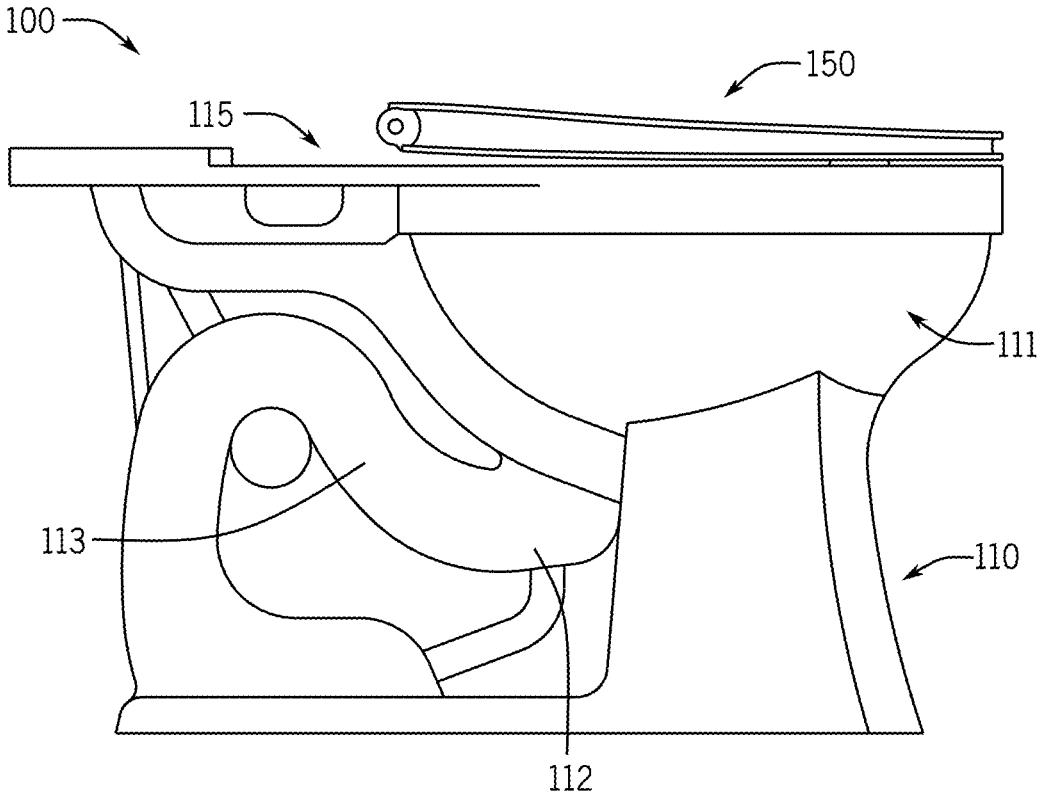
FIG. 3 illustrates a toilet including a toilet seat assembly according to an exemplary embodiment of the present disclosure.

FIG. 3 illustrates a toilet 100 including a toilet seat assembly 150 according to an exemplary embodiment of the present disclosure. Referring to FIG. 1, the toilet 100 includes a base 110 (e.g., a pedestal, bowl). The base is configured to be attached to another object such as a drainpipe, floor, or other suitable object. The base 110 includes a bowl 111, a sump 112 disposed below the bowl and a trapway 113 connecting fluidly connecting the bowl 111 to a drainpipe or sewer line. In some embodiments, the toilet 100 may include a tank. The tank may be supported by the base 110, such as an upper surface of the rim 115. In some embodiments, the tank may be integrally formed with the base 110. In other embodiments, the tank may be formed separately from the base 110 and coupled (e.g., attached, secured, fastened, connected, etc.) to the base 110. The toilet 100 may further include a tank lid covering an opening and an inner cavity in the tank. The toilet 100 may further include a toilet seat assembly 150 rotatably coupled to the base 110. In some embodiments, the toilet 100 may be connected to a waterline that supplies the toilet with water. The toilet 100 of FIG. 1 is provided herein as a non-limiting example of a toilet that may be configured to utilize aspects of the present disclosure.

Figure 4:
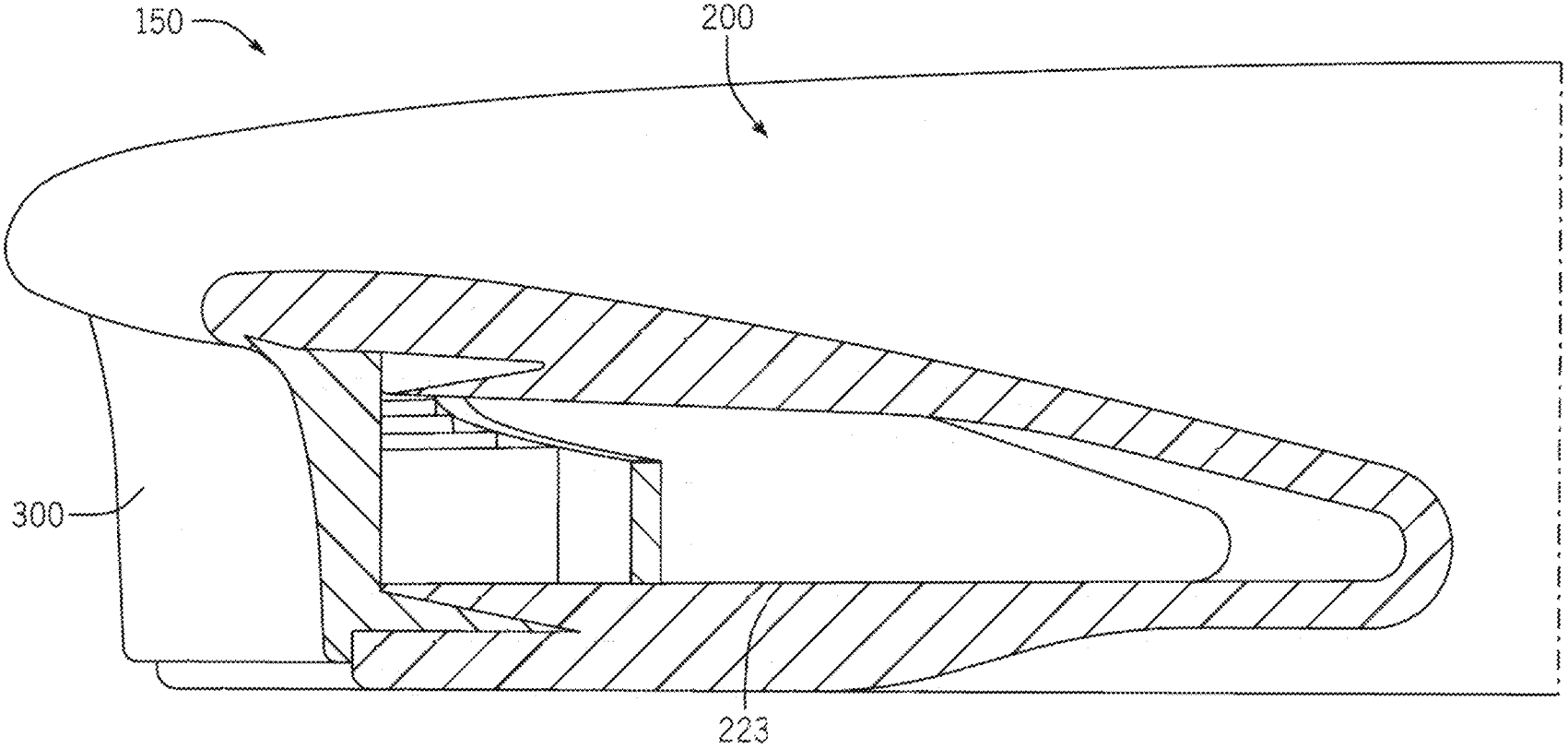
FIG. 4 illustrates a partial cross-section view of a toilet seat assembly according to an exemplary embodiment of the present disclosure.

FIG. 4 illustrates a partial cross-sectional view of a toilet seat assembly 150 according to an exemplary embodiment of the present disclosure. The toilet seat assembly 150 includes a seat 200 and a cushion 300. The cushion 300 may be disposed within the seat 200. The cushion 300 may be removably coupled (e.g., attached, secured, fastened) to the seat 200. In other examples, the cushion 300 may be permanently coupled to the seat 200. The seat 200 and the cushion 300 may be configured to deform elastically and vertically in response to a load being applied to the seat 200. For example, the seat 200 and the cushion 300 may be configured to deform elastically and vertically in response to the weight of a user sitting on the seat 200. In some examples, the cushion 300 may be configured to control (e.g., substantially control) deformation of the seat 200.

In some examples, as illustrated in FIG. 4, the cushion 300 may extend below a bottom surface of a cavity formed in the seat (i.e., cavity bottom surface 223) concealing or hiding a seam or interface between the cushion 300 and a bottom portion of the seat 200. The portion of the cushion 300 extending below the cavity bottom surface may additionally improve the quality of the interface between the cushion 300 and the seat 200 during deformation of the toilet seat assembly 150.

Figure 5:
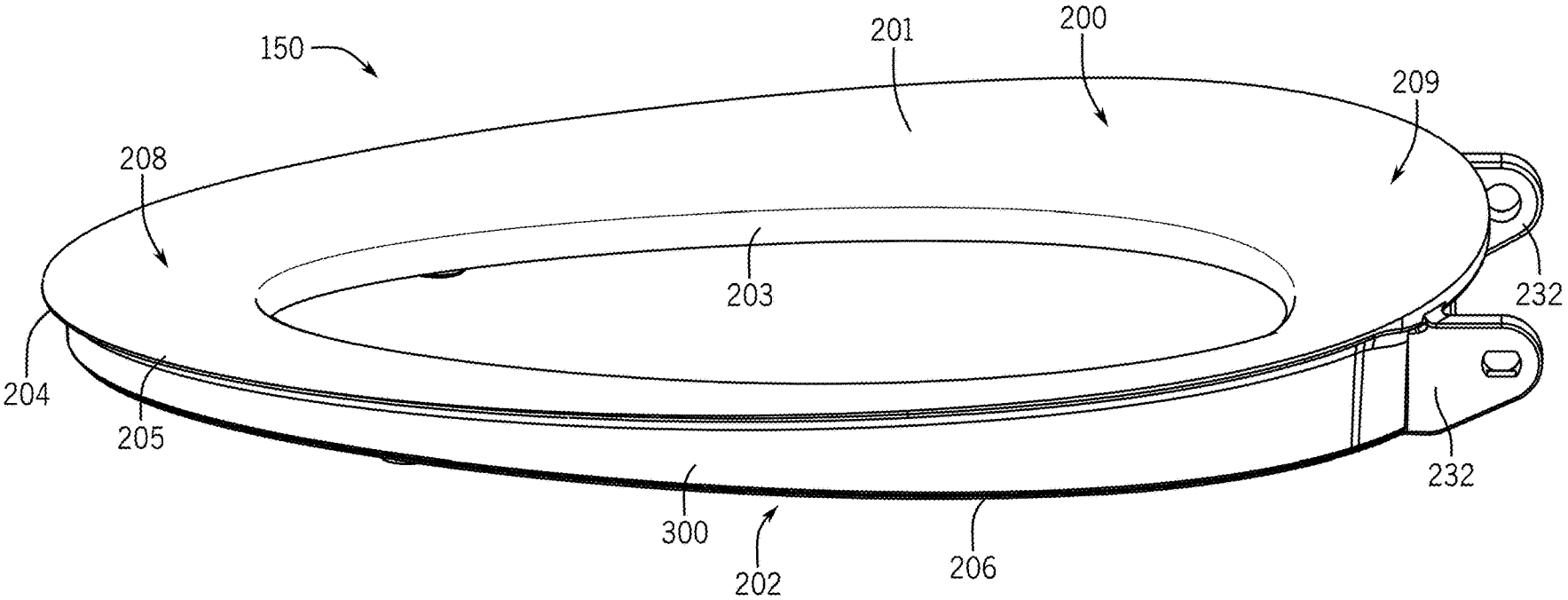
FIG. 5 illustrates a perspective view of a toilet seat assembly according to an exemplary embodiment of the present disclosure.

FIG. 5 illustrates a perspective view of a toilet seat assembly 150 according to an exemplary embodiment of the present disclosure. As illustrated in FIG. 2, the seat 200 includes a seat top surface 201, seat bottom surface 202 opposite the seat top surface 201, and seat inner edge 203 where the seat top surface 201 and the seat bottom surface 202 meet. The seat top surface 201 and the seat bottom surface 202 may each have an oval or elliptic shape. The seat 200 further includes seat outer surface 204 extending from an outer perimeter of the seat top surface 205 to an outer perimeter of the seat bottom surface 206. The seat 200 may further include a seat back end 209 and a seat front end 208. The seat front end 208 may be narrower than the seat back end 209.

The seat 200 further includes a cavity (see FIG. 6) extending from the seat outer surface 204 toward the seat inner edge 203. In the toilet seat assembly 150 as illustrated in FIG. 5, the cushion 300 is disposed within the cavity. In some examples, the cavity may occupy a majority of the seat outer surface 204 extending between the outer perimeter of the seat top surface 205 and the outer perimeter of the seat bottom surface 206. The cushion 300 may be compressed within the cavity 220 of the seat 200 when a user sits on the seat top surface 201, controlling deformation of the seat 200.

Figure 6:
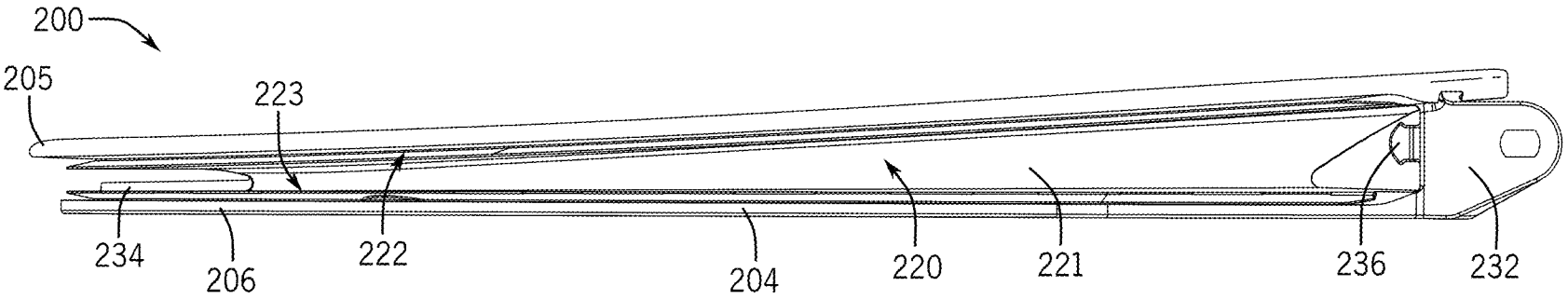
FIG. 6 illustrates a side view of the seat of FIGS. 4 and 5 according to an exemplary embodiment of the present disclosure.

FIG. 6 illustrates a side view of the seat 200 of FIGS. 4 and 5 without the cushion 300. As illustrated, the seat 200 includes cavity 220 in the outer surface 204 of the seat 200. In some examples, as illustrated in FIG. 6, the cavity 220 may occupy a majority of the vertical distance of the seat outer surface 204 between the seat top surface 201 and the seat bottom surface 202. The height of the cavity 220 may vary. In other examples the height of the cavity 220 may be smaller or larger. A cavity inner surface 221 (i.e., cavity interior surface) may define (e.g., the shape of) the cavity 220 in the seat 200. The cavity inner surface 221 may include a cavity top surface 222 and a cavity bottom surface 223. The shape of the cavity 220 may vary.

In some examples, as illustrated in FIG. 6, the cavity 220 extends around the entire seat outer surface 204 (i.e., the cavity 220 extends around the entire outer perimeter of the seat 200). In other examples, the cavity 220 extends around a majority of the seat outer surface 204. In still other examples, the cavity extends around less than half of the seat outer surface 204. In some examples, the cavity 220 may have an arcuate or parabolic shape corresponding to a portion of the seat 200, with the ends of the arcuate or parabolic shape disposed at or near the seat back end 209 and the center of the arcuate or parabolic shape at or near the seat front end 208. The portion of the seat outer surface 204 along which the cavity extends may vary. In some examples, the portion of the seat outer surface 204 along which the cavity 220 extends may be longer or shorter. The depth to which the cavity 220 extends into the seat 200 may vary.

Referring to FIGS. 5 and 6, in some examples, the toilet seat 200 further includes one or more hinge brackets 232 configured to attach or coupled the seat 200 to a hinge assembly. In some examples, as illustrated in FIGS. 5 and 6, the seat 200 may include two hinge brackets 232. The hinge brackets 232 may be disposed at or near the seat back end 209. The hinge brackets 232 may extend between the cavity top surface 222 and the cavity bottom surface 223. The hinge brackets 232 may be configured to receive a pin for rotatably coupling the seat 200 to the toilet.

In some examples, the seat 200 may include one or more locking projections 236. For example, a locking projection 236 may extend radially inward from the hinge bracket 232. In some examples, the locking projection 236 may extend into the cavity 220 of the seat 200. In some examples, as illustrated in FIG. 5, the seat 200 may include two hinge brackets 232 and a locking projection 236 extending from each hinge bracket 232. Each of the hinge brackets 232 and thus each of the locking projections 236 may be disposed at or near the seat back end 209 and offset from a centerline of the seat 200 on opposite sides of the centerline of the seat 200. The locking projection 236 may be configured to be circumscribed by the cushion 300 when the cushion 300 and the seat 200 are coupled to one another. For example, a locking loop of the cushion 300 may be stretched around the locking projection 236 coupling the cushion 300 and the seat 200 to one another.

Referring to FIG. 6, the seat 200 may include a centering rib 234 extending upward from the bottom surface 223 of the cavity inner surface 221. In some examples, the centering rib 234 may extend vertically upward from the bottom surface 223 of the cavity inner surface 221. The centering rib 234 may be configured as a datum or reference point for attaching the cushion 300 to the seat 200. In some examples, the centering rib 234 may extend from the bottom surface 223 of the cavity 220 along a central axis of the seat 200. The centering rib 234 may be configured to center a cushion 300 when a cushion 300 is coupled to the seat 200. A portion of the cushion 300 may surround the centering rib 234 when the cushion 300 is coupled to the seat 200. A center channel formed in the cushion may be configured to receive the centering rib 234 when the cushion 300 and the seat 200 are coupled to one another. The centering rib 234 and center channel of the cushion 300 may control a position of the seat 200 and the cushion 300 relative to one another, when the seat 200 and the cushion 300 are coupled. Additionally, the centering rib 234 and the center channel of the cushion may control a position of the cushion 300 relative to the seat 200 such that there is an equal or substantially similar amount of deformation or stretch in the cushion 300 on both sides of the center channel when the seat 200 and cushion 300 are coupled.

Figure 7:
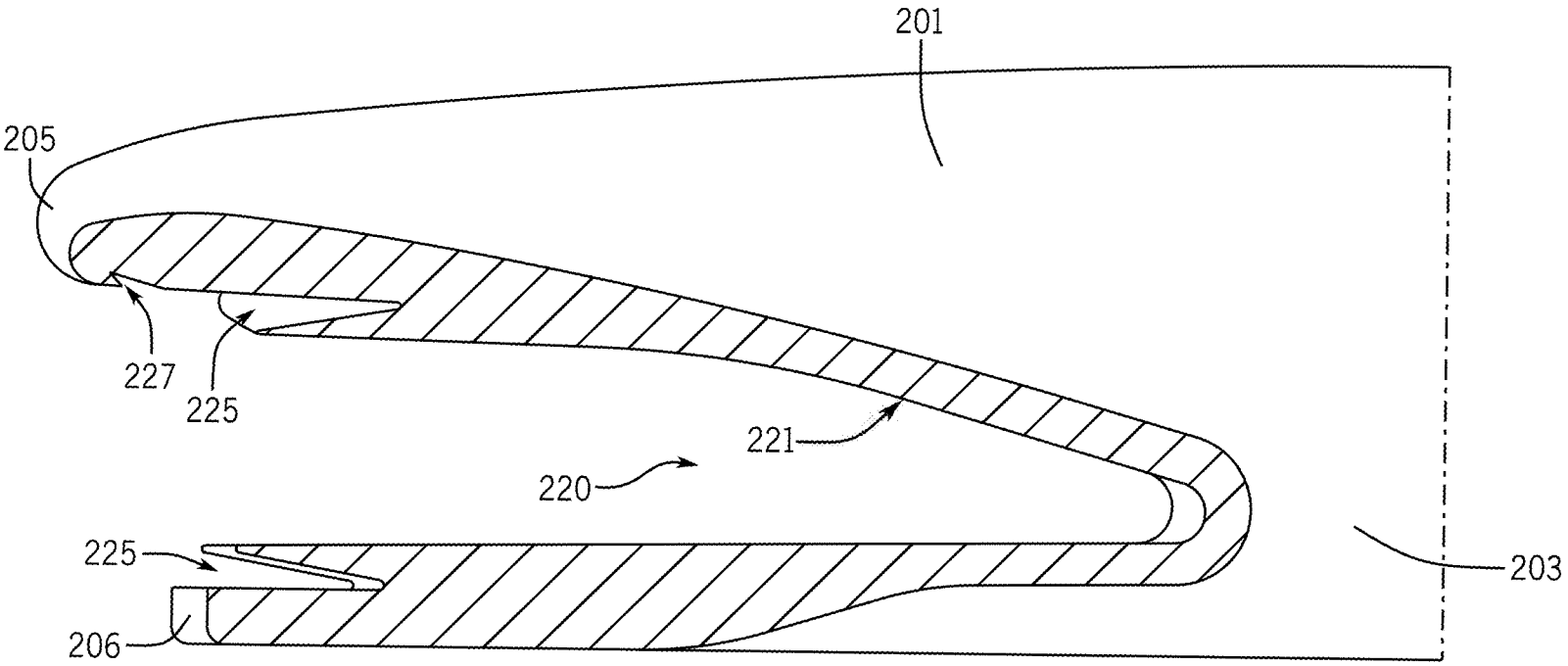
FIG. 7 illustrates a partial cross-section view of a seat according to an exemplary embodiment of the present disclosure.

FIG. 7 illustrates a partial cross sectional view of the seat 200 according to an exemplary embodiment of the present disclosure. In some examples, the seat 200 may further include one or more locking features comprising a 225 configured to receive a portion of the cushion 300. Each of the slots 225 may be configured to secure the cushion 300 within the seat 200. Additionally, each of the slots 225 may advantageously prevent contaminants (e.g., dirt, dust, odor causing bacteria) from entering the cavity 220.

In some examples, as illustrated in FIG. 7, the seat 200 may include two slots 225. Each of the slots 225 may be disposed in the cavity 220 of the seat 200. For example, a first slot 225 may be disposed in the top surface 222 of the cavity 220 and a second slot 225 may be disposed in the bottom surface 223 of the cavity 220. In some examples, a slot 225 in the top surface 222 of the cavity may be disposed closer to the seat inner edge 203 than the slot formed in the bottom surface 223 of the cavity 220. The location and/or number of slots 225 may vary. For example, the seat 200 may include a single slot 225. The shape of the slots 225 may vary. For example, as illustrated in FIG. 7, the seat 200 may include a triangular or substantially triangular slot 225. In other examples, the slot may be rectangular, semi-circular, semi-spheroid or the like. In some examples, the locking feature(s) may extend along the entire length of the cavity 220. In other examples, the locking features may be provided intermittently along the length of the cavity 220.

The seat 200 may further include one or more grooves 227 disposed in the cavity inner surface 221. For example, as illustrated in FIG. 7, a single groove 227 may be disposed in the cavity inner surface 221 at or near a top of the cavity 220. In some examples, the groove 227 may be disposed between a slot 225 (e.g., first slot) and the outer perimeter of the seat top surface 205. The groove 227 may be configured to receive an exterior flange of the cushion 300 when the cushion 300 and the seat 200 are coupled to one another. In some examples, the groove 227 may have a triangular or a substantially triangular shape. In other examples, the groove may have a rectangular shape, a semi-circular, a semi-elliptic, or any other suitable shape. The shape of the groove 224 and a shape of the exterior flange of the cushion 300 may mirror one another. In some examples, the seat 200 may include two or more grooves 227. For example, the seat 200 may include a first groove in the cavity inner surface 221 at or near a top of the cavity 220 and a second groove in the cavity inner surface 221 at or near a bottom of the cavity 220. The groove(s) in the seat 200 may advantageously improve a seam between the seat 200 and the cushion 300 when the seat 200 and the cushion 300 are coupled to one another, securing, or locking a position of the seat 200 and cushion 300 relative to one another, and preventing contaminants from entering the cavity 220 of the seat.

In some examples, the seat 200 may be comprised of plastics, such as polypropylene (PP), polyethylene, polycarbonate, or other similar materials. In other examples, the seat may be comprised of another material. The seat 200 may be comprised of a different material than the cushion 300. The material comprising the seat 200 may have a higher durometer than a material comprising the cushion 300.

Figure 8:
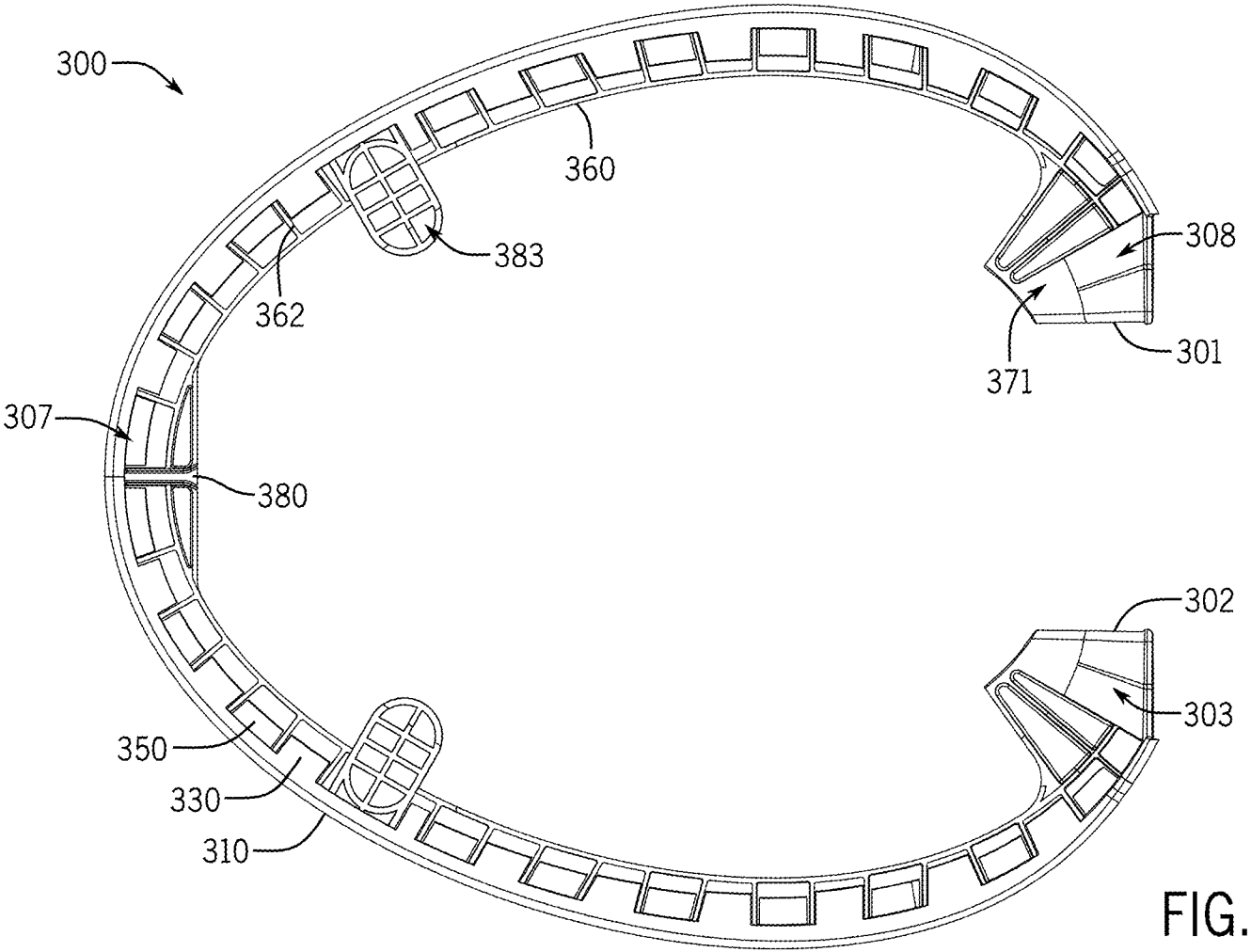
FIG. 8 illustrates a top view of a cushion according to an exemplary embodiment of the present disclosure.

FIG. 8 illustrates a top view of the cushion 300 of FIG. 5. In this example, the cushion 300 has an arcuate shape extending from a first end 301 to a second end 302. The cushion 300 includes a cushion outer wall 310. In some examples, a vertical height of the outer wall 310 may vary along the length of the outer wall 310. For example, the outer wall 310 may have a largest vertical height at or near the first end 301 and the second end 302 and a smallest vertical height at a front end 307 of the cushion 300. A vertical height of the outer wall 310 may gradually increase from a front end 307 of the cushion 300 to each of the first end 301 and the second end 302. The thickness of the cushion outer wall 310 may vary. The cushion outer wall 310 extends between a top surface 222 of the cavity 220 and a bottom surface 223 of the cavity 220 when the cushion 300 and the seat 200 are coupled to one another. The cushion outer wall 310 is configured to deform elastically when a user sits on the toilet seat assembly 150.

The cushion outer wall 310 includes a cushion outer surface 311 defining an outer perimeter of the cushion 300. The cushion outer surface 311 may be exposed to an exterior of the toilet seat assembly 150 when the cushion 300 is coupled to the seat 200. In some examples, the cushion outer surface 311 may be the only surface of the cushion exposed to the exterior of the toilet seat assembly 150 when the cushion 300 is coupled to the seat 200.

Figure 9:
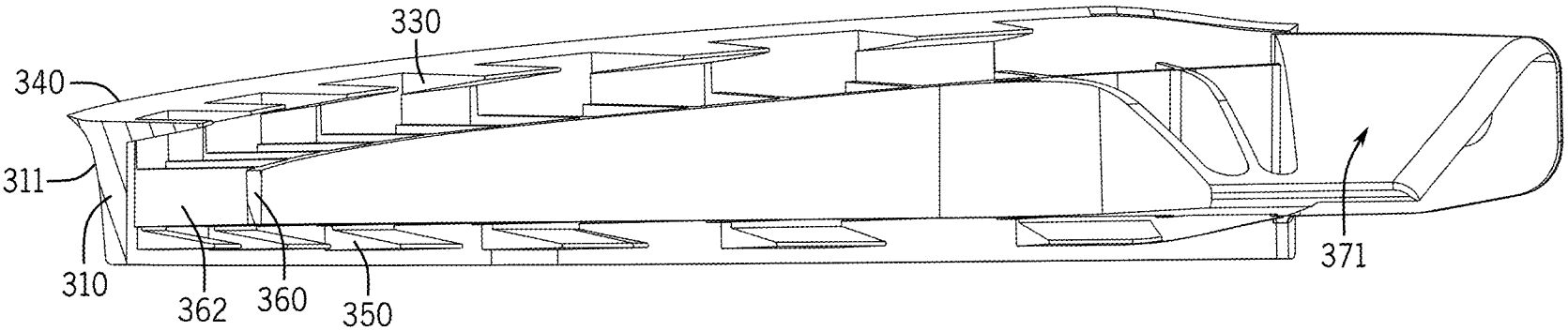
FIG. 9 illustrates a partial cross section view of a cushion according to an exemplary embodiment of the present disclosure.

The cushion 300 further includes an upper flange 330 extending radially inward from the cushion outer wall 310. The upper flange 330 may be disposed at or near a top of the cushion outer wall 310. In some examples, as illustrated in FIGS. 8 and 9, the cushion 300 may include a plurality of upper flanges 330 extending radially inward from the cushion outer wall 310. In some examples, the plurality of upper flanges 330 may extend along the outer wall 310 at a regular interval. In other examples, the plurality of upper flanges 330 may extend along the outer wall 310 at an irregular interval. In some examples, a single upper flange 330 may extend along the entire length of the cushion outer wall 310.

The upper flange(s) 330 may be configured to reside in a slot 225 disposed in a top surface 222 of the cavity 220 when the cushion 300 and the seat 200 are coupled to one another. The upper flange(s) 330 and the slot 225 may advantageously improve a seam or interface between the seat 200 and the cushion 300 when the seat 200 and the cushion are coupled to one another. The upper flange(s) 330 of the cushion may be maintained within the slot 225 of the seat 200 preventing the cushion 300 and the seat 200 from moving relative to one another.

A shape of the upper flange(s) 330 and a shape of the slot 225 may mirror one another. In some examples, as illustrated in FIGS. 7-9, the upper flanges 330 and the slot 225 may have a triangular or substantially triangular shape. The shape of the upper flange(s) 330 and/or slot 225 may vary. For examples, the upper flange(s) 330 and/or slot may have a rectangular, semi-circular, or semi-elliptic shape. In some examples, the upper flange(s) 330 and the slot 225 may have different shapes.

The cushion 300 may further include an exterior flange 340 extending upward and/or radially outward from the cushion outer wall 310. In some examples, as illustrated in FIG. 8, a single exterior flange 340 may extend along the entire length of the cushion outer wall 310. In some examples, a plurality of exterior flanges may extend from for the cushion outer wall at regular or irregular intervals. The exterior flange 340 may be configured to reside in the groove 227 when the cushion 300 and the seat are coupled to one another. Accordingly, a shape of the exterior flange 340 and a shape of the groove 227 may mirror one another. In some examples, the exterior flange 340 may have a triangular or a substantially triangular shape. In other examples, the exterior flange 340 may have a rectangular shape, a semi-circular, a semi-elliptic, or any other suitable shape.

The cushion 300 may further include a lower flange 350 extending radially inward from the cushion outer wall 310. The lower flange 350 may be disposed below the upper flange 330. The lower flange 350 may be disposed at or near a bottom of the cushion outer wall 310. In some examples, as illustrated in FIGS. 8 and 9, the cushion 300 may include a plurality of lower flanges 350 extending radially inward from the cushion outer wall 310. In some examples, the plurality of lower flanges 350 may extend along the cushion outer wall 310 at a regular interval. In other examples, the plurality of lower flanges 350 may extend along the cushion outer wall 310 at irregular intervals. In some examples, a single lower flange 350 may extend along the entire length of the cushion outer wall 310.

The lower flange(s) 350 may be configured to reside in a slot 225 disposed in the cavity bottom surface 223 when the cushion 300 and the seat 200 are coupled to one another. The lower flange(s) 350 and the slot 225 may advantageously improve a seam or interface between the seat 200 and the cushion 300 when the seat 200 and the cushion are coupled to one another. The lower flange(s) 350 of the cushion may be maintained within the slot 225 of the seat 200 preventing the cushion 300 and the seat 200 from moving relative to one another.

A shape of the lower flange(s) 350 and a shape of the slot 225 may mirror one another. In some examples, as illustrated in FIGS. 7-9, the lower flanges 350 and the slot 225 may have a triangular or substantially triangular shape. The shape of the lower flange(s) 350 and/or slot 225 may vary. For examples, the upper flange(s) 330 and/or slot 225 may have a rectangular, semi-circular, or semi-elliptic shape. In some examples, the lower flange(s) 350 and the slot 225 may have different shapes.

In some examples, as illustrated in FIG. 8, the plurality of upper flanges 330 and the plurality of lower flanges 350 may be staggered such that upper flanges 330 and lower flanges 350 alternate along the outer wall 310. For example, the outer wall 310 may include only an upper flange 330 for a length along the outer wall and then only a lower flange 350 for a length along the wall. This pattern may repeat along the outer wall 310. In some examples, there may be gap or space without an upper flange 330 or a lower flange 350 between the upper flange 330 and the lower flange 350. In some examples, the length of an upper flange along the outer wall 310 may be longer than the length of a lower flange along the outer wall 310. In some examples, the length of upper flange(s) 330 and the lower flange(s) 350 may be the same. In some examples, a total length of all of the upper flange(s) 330 may be the same as a total length of all the lower flange(s) 350. In other examples, the total length of all the upper flanges(s) 330 may be shorter or longer than the total length of all the lower flange(s) 350.

In some examples, the cushion 300 may include a cushion inner wall 360 disposed radially inward from the cushion outer wall 310. A height and/or thickness of the cushion inner wall 360 may vary. In some examples, a height of the cushion inner wall 360 may vary along the length of the cushion inner wall 360. The cushion inner wall 360 may be configured to deform elastically when a user sits on the toilet seat assembly 150. In some examples, as illustrated in FIG. 9, the inner wall 360 may have a smaller vertical height than the outer wall 310. In other examples, the inner wall 360 and the outer wall 310 may have the same vertical height.

A plurality of bridges 362 may extend radially inward from the cushion outer wall 310 connecting the cushion outer wall 310 and the cushion inner wall 360. A thickness of the plurality of bridges 362 may vary. A height of the plurality of bridges 362 may vary. For example, the plurality of bridges 362 may have the same vertical height as the cushion inner wall 360. In some examples, the height of the plurality of bridges 362 may vary along the length of the plurality of bridges 362. For example, a height of the bridge may gradually decrease from a height of the outer wall 310 at the outer wall 310 to a height of the inner wall 360 at the inner wall 360. In some examples, a bridge 362 may be disposed between adjacent flanges (e.g., upper flange 330, lower flange 350) of the cushion 300.

Figure 10:
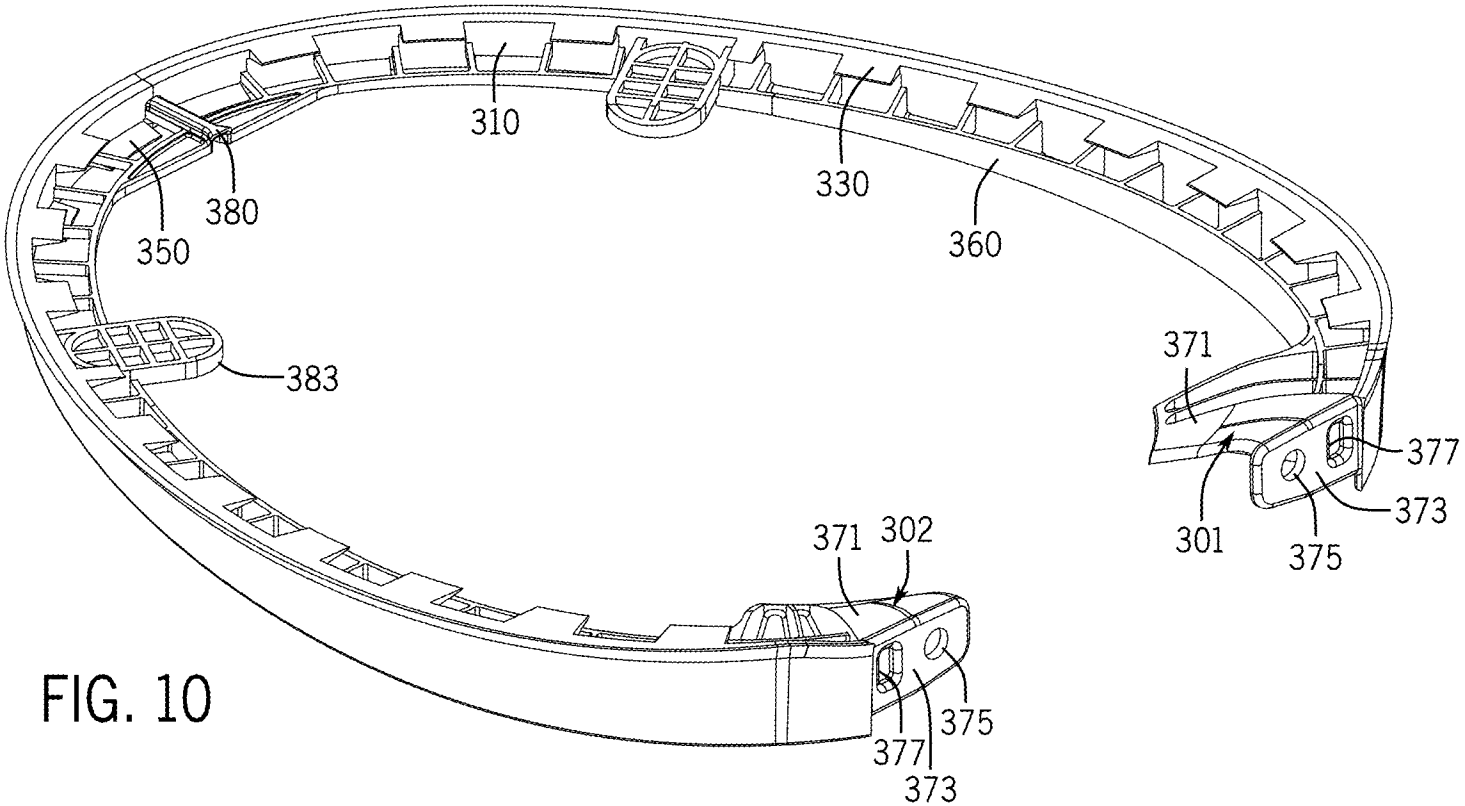
FIG. 10 illustrates a perspective view of a cushion according to an exemplary embodiment of the present disclosure.

FIG. 10 illustrates a perspective view of the cushion 300 of FIGS. 5, 8, and 9. In some examples, as illustrated in FIG. 10, the cushion 300 includes a locking rib 371 at each of the first end 301 and the second end 302 of the cushion 300. The locking rib 371 is configured to extend radially inward from the outer wall 310 and/or the inner wall 360. The locking rib 371 is disposed in the cavity 220 of the seat 200 when the cushion 300 and the seat 200 are coupled to one another. The locking rib 371 may contact the bottom surface 223 of the cavity 220 when the cushion 300 is coupled to the seat 200. The locking rib 371 may contact the top surface 222 of the cavity 220 when the cushion 300 is coupled to the seat 200. The locking rib 371 may help maintain a position of the cushion 300 relative to the seat 200 when the cushion 300 and seat are coupled to one another. The locking rib 371 may advantageously prevent the cushion 300 from uncoupling with the seat 200 during deformation of the cushion 300.

In some examples, the cushion 300 may include a center channel 380. The center channel 380 may be a datum or reference point for coupling the cushion 300 to the seat 200. For example, the center channel 380 may be aligned with a centering rib 234 of the seat 200 when coupling the cushion 300 to the seat 200. The centering channel 380 may receive the centering rib 234 when the cushion 300 is slid or positioned into the center channel 380. The center channel 380 may secure or maintain a position of the centering rib 234 when the cushion 300 is coupled to the seat 200.

Collectively, the center channel 380 and the centering rib 234 may control a position of the cushion 300 relative to the seat 200 when the cushion 300 is coupled to the seat 200. Additionally, the center channel 380 and the centering rib 234 may control deformation or stretch of the cushion 300 when the cushion 300 is stretched to be coupled to the seat 200. The center channel 380 and the centering rib 234 may also control deformation or stretch of the cushion 300 when the cushion 300 is in a stretched state of being coupled to the seat 200. For example, the center channel 380 and the centering rib 234 may ensure that there is an equal or substantially similar amount of deformation or stretch in the cushion 300 on both side of the center channel 380.

Figure 11:
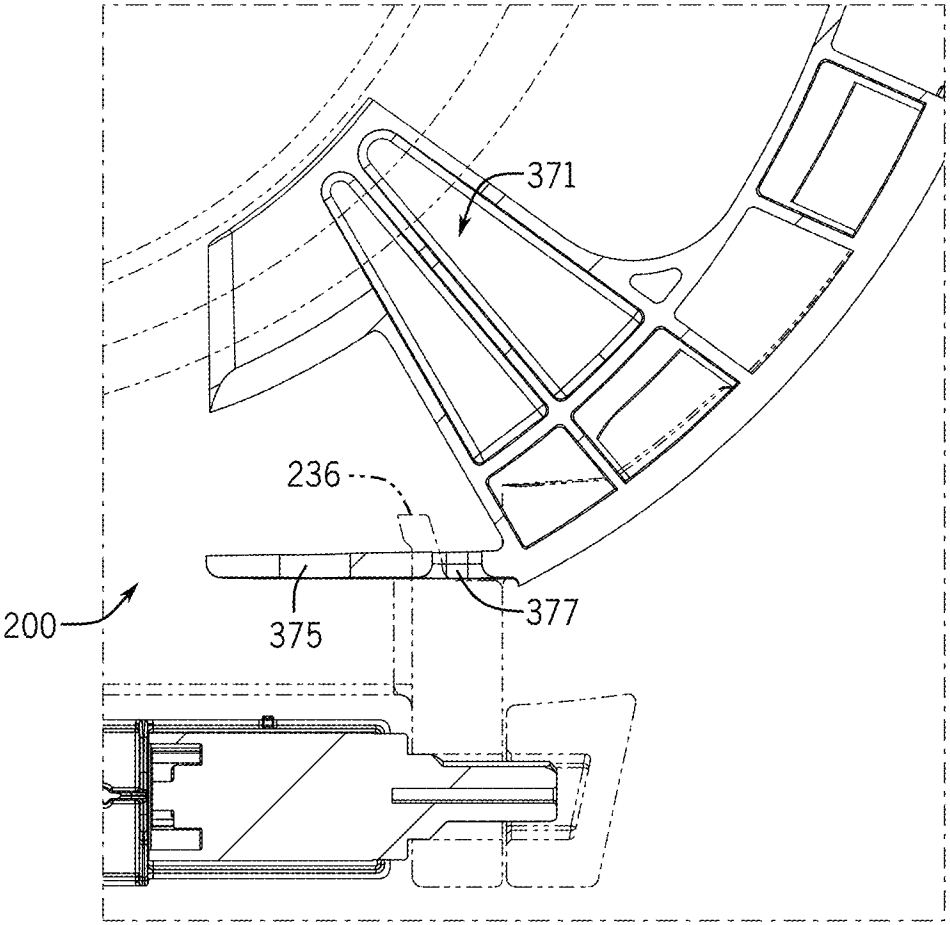
FIG. 11 illustrates a partial cross-section view of a toilet seat assembly according to an exemplary embodiment of the present disclosure.

In some examples, as illustrated in FIG. 10, the cushion 300 includes a locking tab 373 at each of the first end 301 and the second end 302. The locking tabs may be configured to engage with the seat 200 when the cushion 300 is in a stretched state, coupling the cushion 300 to the seat 200. Each of the locking tabs 373 (and the cushion 300 generally) may be configured to be stretched around the seat to couple the cushion 300 to the seat 200. For example, each locking tab 373 may include a fastening loop 375 and a locking loop 377. The fastening loop 375 may be configured to be clasped by a user and/or a tool to stretch the cushion 300 around the seat 200. The locking loop 377 may be configured to be stretched to engage or circumscribe a portion of the seat 200 coupling the cushion 300 to the seat 200. For example, the locking loop 377 may be stretched to circumscribe a locking projection 236 of the seat 200, coupling the cushion 300 to the seat 200. FIG. 11 illustrates a locking loop 377 engaged with or circumscribing a locking projection 236 according to an exemplary embodiment of the present disclosure.

Figure 12:
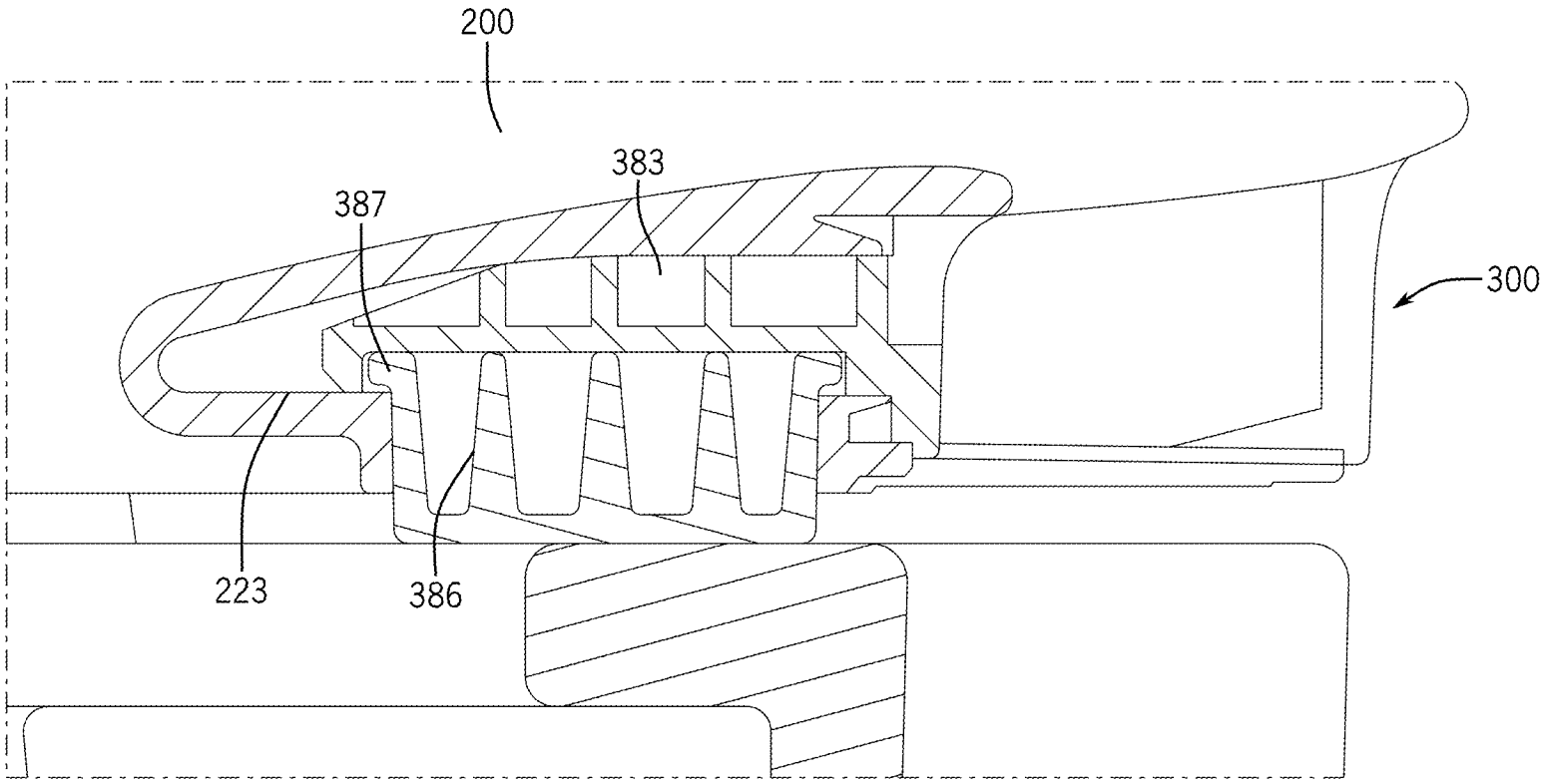
FIG. 12 illustrates a partial cross-section view of a toilet seat assembly according to an exemplary embodiment of the present disclosure.

FIG. 12 illustrates a partial cross section of the toilet seat assembly 150 according to an exemplary embodiment of the present disclosure. As illustrated in FIG. 12, a bumper pocket 237 may extend through the seat 200 from the cavity bottom surface 223 to the seat bottom surface 202. The shape of the bumper pocket 237 may vary. For example, the bumper pocket 237 may have an oval shape when viewed from below the seat 200. In other examples, the bumper pocket 237 may have an oblong, rectangular, circular, or another shape. The bumper pocket 237 may be configured to receive a bumper 386. The bumper pocket 237 and the bumper 386 may have the same shape. For example, both the bumper pocket 237 and the bumper 386 may have an oval shape when viewed from below the seat 200. The bumper 386 may include a bumper flange 387 protruding from the bumper 386. The bumper flange 387 may contact the cavity bottom surface 223, preventing the bumper 386 from translating through the bumper pocket 237.

The bumper 386 may be comprised of a rubber or a rubber like resin. For example, the bumper 386 may be comprised of a thermoplastic elastomer (TPE) such as thermoplastic vulcanizate (TPV), styrenic block copolymers (TPE-S), thermoplastic polyolefins (TPE-O), thermoplastic polyurethanes (TPE-U), thermoplastic copolyesters (TPE-E), melt processable rubber (MPR), thermoplastic polyether block amides (TPE-A), ethylene vinyl acetate (EVA) or a combination thereof. In this embodiment, the bumper 386 may be formed of a different material than the cushion 300. In some embodiments, the bumper 386 may be comprised of two or more materials. In one example, the bumper 386 may include a polypropylene (PP) shell and over molded with a rubber or rubber like resin. Accordingly, the grip performance of the bumper may be maximized.

Further, referring to FIG. 12, in some examples, the cushion 300 may include a bumper pad 383. The bumper pad 383 may be configured to secure or maintain a position of the bumper 386. When the cushion 300 is coupled to the seat 200, the bumper pad 383 may align with the bumper 386 such that the bumper pad 383 contacts the bumper 386. In some examples, the bumper pad 383 may extend between the cavity top surface 222 and bumper pad 383. In some examples, the bumper pad 383 may further include a locking edge 388 extending downward from the bumper pad 383. The locking edge 388 may be configured to engage or contact the bumper 386, for example, the bumper flange 387, securing or locking the position of the bumper 386 and the cushion 300 when the cushion 300 is coupled to the seat 200. In some examples, the seat 200 may include two or more bumper pockets 237 each configured to receive a bumper 386 and the cushion 300 may include a bumper pad 383 for each bumper 386.

Referring to FIGS. 3-11, the toilet seat assembly 150 may be configured to deform elastically and vertically when a force is applied to a top surface 201 of the seat 200. Specifically, the seat 200 and the cushion 300 may be configured to deform elastically and vertically when the weight of a user is applied to the seat top surface 201. More specifically, the seat inner edge 203, the outer perimeter of the seat top surface 205, and the cushion 300 may be configured to deform elastically and vertically. The shape of the seat 200 and cushion 300 and the materials comprising the seat 200 and cushion 300 may be specifically selected to provide a desired deformation of the toilet seat assembly 150 when a user sits on the seat. The deformation or flex of the toilet assembly may be controlled to improve the comfort of a user when they sit on the toilet seat assembly 150. In one example, the cushion 300 may be configured to maximize deformation at the outer perimeter of the seat top surface 205, thereby improving comfort for large users.

Further, the toilet seat assembly 150 may be configured to deform differently for different users. For example, the toilet seat assembly may deform differently for a small user than for a large user. In another, the toilet seat assembly 150 may deform differently for a lighter user than a heavier user. The toilet seat assembly may deform differently depending on a magnitude and/or a location(s) where a load is applied. In another example, the inner edge 203 of the seat 200 may be configured to deform elastically and vertically downward in response to a smaller user (because the user is only occupying that portion of the seat). Conversely, an outer perimeter of the seat top surface 205 may be configured to deform elastically and vertically in response to a larger user (because this is the location occupied by a user and where a majority of the load is applied by the user.

Deformation or flex of the toilet seat assembly 150 may be controlled by the materials comprising the seat 200 and/or the cushion 300. Deformation of the toilet seat assembly may be controlled by a shape of the seat 200 and/or cushion 300. For example, deformation may be controller by a thickness of the seat 200 and/or cushion 300. Deformation of the toilet seat assembly 150 may further be controlled by a varying cross-sectional profile or bending profile of the seat 200 and/or cushion 300.

In some embodiments, the cushion 300 may be configured to determine or control deformation of the seat. Accordingly, deformation of the toilet seat assembly 150 may be changed by changing the cushion 300. A material comprising the cushion 300 may determine or control deformation of the toilet seat assembly 150 In some embodiments, the cushion 300 may be comprised of two or more materials. The material or materials comprising the cushion may be selected for their physical properties. For example, the material or materials comprising the cushion may be selected based on their durometer. The cushion 300 may be comprised of a rubber or rubber like resin. For example, the cushion 300 may be comprised of a thermoplastic elastomer (TPE) such as thermoplastic vulcanizate (TPV), styrenic block copolymers (TPE-S), thermoplastic polyolefins (TPE-O), thermoplastic polyurethanes (TPE-U), thermoplastic copolyesters (TPE-E), melt processable rubber (MPR), thermoplastic polyether block amides (TPE-A), ethylene vinyl acetate (EVA) or a combination thereof. In another example, the cushion 300 may be comprised of silicone rubber or flexible PVC.

During use of the toilet seat assembly 150, the seat bottom surface 202 may be supported by an upper or top surface of the rim 115 and a force (e.g., weight) may be applied to the seat top surface 201. The seat 200 and the cushion 300 may be configured to deform elastically and vertically in response to a compressive force between the user and an upper surface of the rim of the toilet. The cushion 300 may be compressed within the cavity 220 of the of the seat 200.

Specifically, the cushion outer wall 310 may be compressed between the cavity top surface 222 and the cavity bottom surface 223 as the seat 200 deforms. In some examples, a spring constant or amount of force required to compress the cushion outer wall 310 a specific distance may control or substantially control deformation of the seat 200. The spring constant of the cushion outer wall 310 may vary. The spring constant of the outer wall 310 may vary based on the material comprising the cushion outer wall 310, a thickness of the cushion outer wall 310, and a shape of the cushion outer wall 310.

In some examples, as described above, the cushion 300 may further include a cushion inner wall 360. The cushion outer wall 310 and the cushion inner wall 360 may provide two-stage deformation of the toilet seat assembly 150 when a force is applied to the seat top surface 201. During an initial or primary deformation of the toilet seat assembly 150 only the cushion outer wall 310 may be compressed between the cavity top surface 222 and the cavity bottom surface 223. During a secondary deformation of the toilet seat assembly 150, both the cushion outer wall 310 and the cushion inner wall 360 may be compressed between the cavity top surface 222 and the cavity bottom surface 223.

In some examples, the cushion outer wall 310 may be taller than the cushion inner wall 360. Accordingly, during an initial deformation of the seat 200, only the cushion outer wall 310 may be compressed between the cavity top surface 222 and the cavity bottom surface 223. After the initial deformation, the seat 200 may be displaced such that the cavity top surface 222 is in contact with the cushion inner wall 360. Accordingly, during a secondary deformation of the toilet seat assembly 150, the both the cushion outer wall 310 and the cushion inner wall 360 may be compressed between the cavity top surface 222 and the cavity bottom surface 223. During the initial deformation, the spring constant of the cushion outer wall 310 may control or dictate deformation of the seat 200. During secondary deformation, a combined or total spring constant of both the cushion outer wall 310 and the cushion inner wall 360 may control or dictate deformation of the seat 200.

In some examples, the height of the one or more bridges 362 may decrease from a height of the cushion outer wall 310 at the cushion outer wall 310 to a height of the cushion inner wall 360 at the cushion inner wall 360. In these examples, the cushion 300 may provide a continuously increasing spring constant during the initial deformation, as the portion of the bridge 362 compressed between cavity top surface 222 and the cavity bottom surface 223 increases as the toilet seat assembly 150 deforms.

Figure 13:
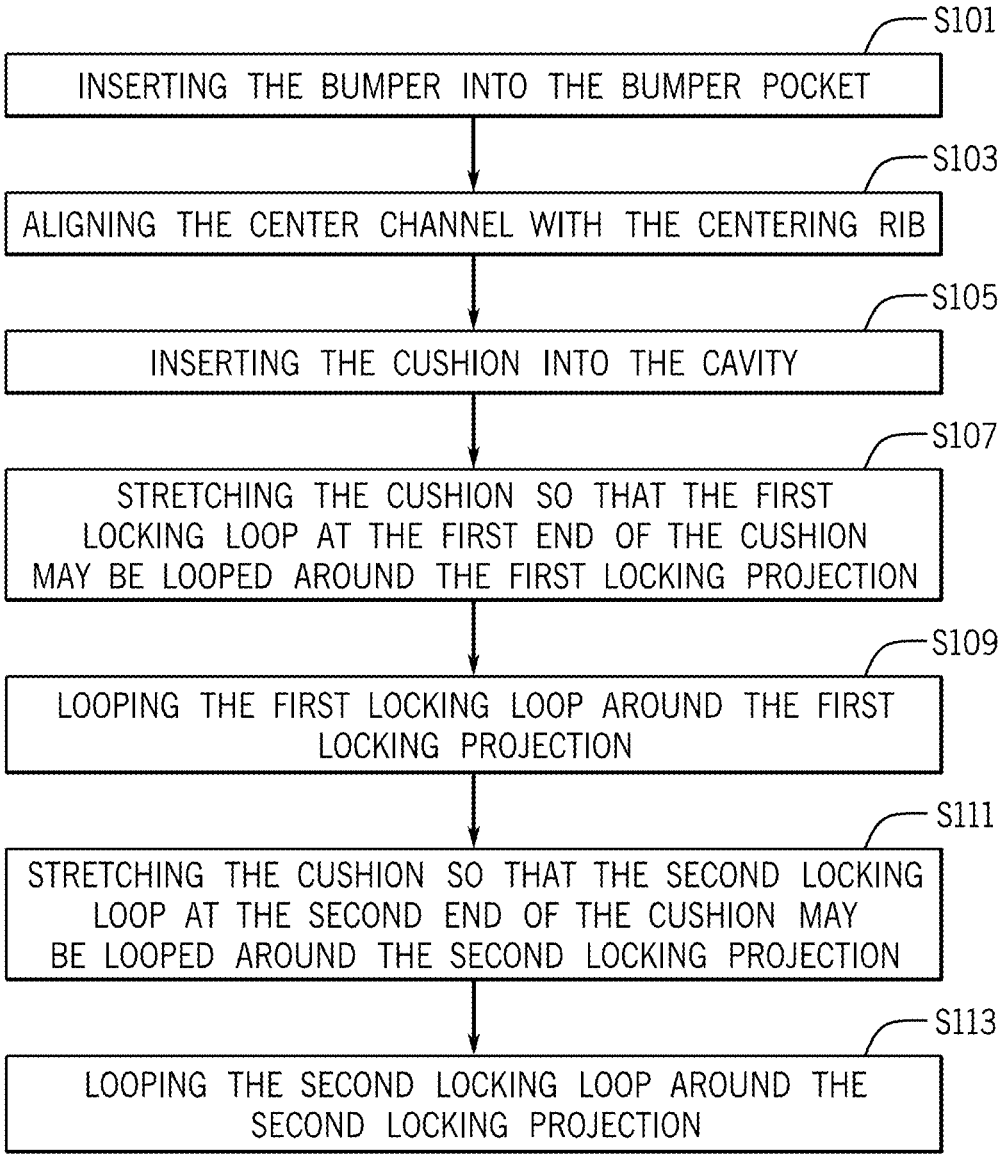
FIG. 13 illustrates a flowchart for coupling a cushion to a seat according to an exemplary embodiment of the present disclosure.

FIG. 13 illustrates a flow chart for coupling a cushion to a seat according to an exemplary embodiment of the present disclosure. The flow chart may be used to couple various toilet seat assemblies (e.g., cushions and seats) described herein. For ease of explanation, the flow chart of FIG. 13 is described below with respect to the toilet seat assembly 150 including cushion 300 and seat 200. Additional, different, or fewer acts may be provided.

At act S101, the bumper 386 is inserted into the bumper pocket 237 of the seat 200. The bumper 386 may be inserted into the bumper pocket 237 through the cavity 220 of the seat. The bumper 386 may be inserted into the bumper pocket 237 so as to extend through the bumper pocket 237. When the bumper 386 is inserted in the bumper pocket 237, the bumper flange 387 may contact the cavity bottom surface 223. In some examples, two or more bumpers 386 may each be inserted into different bumper pockets 237 at act S101. In some examples, more than two bumpers 386 may each be inserted into different bumper pockets 237 at act S101.

At act S103, the center channel 380 of the cushion 300 is aligned with the centering rib 234 of the seat 200. The center channel 380 may be aligned with the centering rib 234 so as to receive the centering rib 234 when the cushion 300 is inserted into the cavity 220 of the seat 200. The center channel 380 and the centering rib 234 may be aligned to control a position of the cushion 300 relative to the seat 200 when the cushion 300 is coupled to the seat 200. In some examples, the center channel 380 and the centering rib 234 may control an amount of deformation or stretch in the cushion 300 when the cushion 300 is stretched to be coupled to the seat 200. The center channel 380 and the centering rib 234 may control deformation or stretch of the cushion 300 such that there is the same or a substantially similar amount of stretch in the cushion 300 on both sides of the center channel 380 when the cushion 300 is coupled to the seat 200.

At act S105, the cushion 300 is inserted into to cavity 220 of the seat 200. The cushion 300 may be inserted into the cavity 220 such that the centering rib 234 is received in the center channel 380 of the cushion 300. In some examples, at act S105, only a portion of the cushion 300 is inserted into the cavity 220.

At act S107, the cushion 300 is stretched so that a first locking loop 377 disposed at a first end 301 of the cushion 300 may be looped around a first locking projection 236 of the seat 200. At act S107, the center channel 380 and the centering rib may fix or maintain a position of the cushion 300 at the center channel 380 such that the first end 301 of the cushion 300 may be stretched. The first locking loop 377 may be located on a first locking tab 373 disposed at or near the cushion 300 first end 301. The first locking projection 236 may extend from a hinge bracket 232 disposed at or near a back end of the seat 200. In some examples, at act 107, a fastening loop 375 disposed at or near the cushion 300 first end 301 may be grabbed by a user to stretch the cushion 300. In other examples, a tool including a hook may be inserted into the fastening loop 375 to stretch the cushion 300.

At act S109, the first locking loop 377 is looped around the first locking projection 236. The first locking loop 377 may be looped around the first locking projection 236 so as to circumscribe the first locking projection 236. When the first locking loop 377 circumscribes the first locking projection 236, the cushion 300 may be stretched between the center channel 380 and the first locking loop 377 so as to be disposed within the cavity 220 and coupled to the seat 200.

At act S111, the cushion 300 is stretched so that a second locking loop 377 disposed at a second end 302 of the cushion 300 may be looped around a second locking projection 236 of the seat 200. At act S111, the center channel 380 and the centering rib may fix or maintain a position of the cushion 300 at the center channel 380 such that the second end 302 of the cushion 300 may be stretched. The second locking loop 377 may be located on a second locking tab 373 disposed at or near the cushion 300 second end 302. The second locking projection 236 may extend from a hinge bracket 232 disposed at or near a back end of the seat 200. In some examples, at act S111, a fastening loop 375 disposed at or near the cushion 300 second end 302 may be grabbed by a user to stretch the cushion 300. In other examples, a tool including a hook may be inserted into the fastening loop 375 to stretch the cushion 300.

At act S109, the second locking loop 377 is looped around the second locking projection 236. The second locking loop 377 may be looped around the second locking projection 236 so as to circumscribe the second locking projection 236. When the second locking loop 377 circumscribes the second locking projection 236, the cushion 300 may be stretched between the center channel 380 and the second locking loop 377 so as to be disposed within the cavity 220 and coupled to the seat 200.

When both the first and second locking loops 377 have been looped around the first and second locking projections 236, the cushion 300 may be stretched around the seat 200 between the first and second locking loops 377 coupling the cushion 300 to the seat 200. In some examples, a cover may be attached to a back side of the seat 200 between the first and second locking projections 236 to hide or conceal the locking tabs 373 disposed at the cushion 300 first end 301 and second end 302, respectively.

Figure 14:
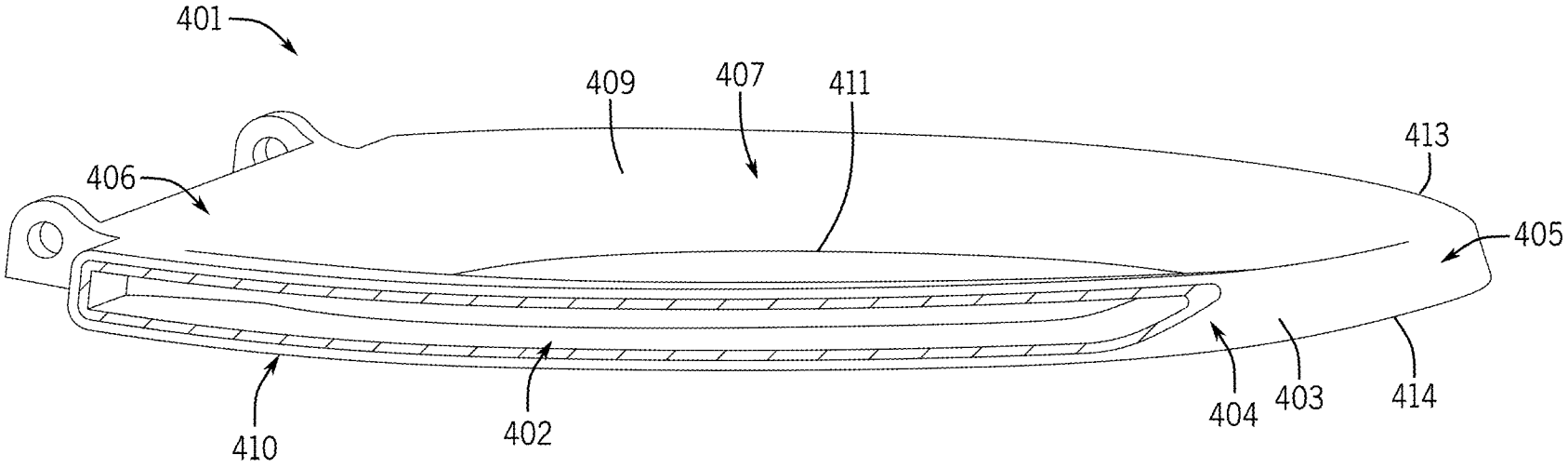
FIG. 14 illustrates a perspective view of a seat according to an exemplary embodiment of the present disclosure.

Referring generally to FIG. 14, in some examples, the seat 401 may include two or more seat cavities 402. Each of the two or more seat cavities 402 may be disposed in the seat outer surface 403. In some examples, a first cavity 402 may be formed in seat first side 404 between a seat front end 405 and a seat back end 406 and a second cavity 402 may be formed in the seat second side 407. The height and or portion of the seat outer surface 403 along which the cavities extend may vary. Each of the cavities 402 may be configured to receive a cushion.

Specifically, FIG. 14 illustrates a perspective view of a toilet seat 401 according to another embodiment of the present disclosure. Like the toilet seat 200, the toilet seat 401 includes annular seat top surface 409, annular seat bottom surface 410 opposite the seat top surface 409, and seat inner edge 411 where the seat top surface 409 and seat bottom surface 410 meet. Additionally, the seat 401 includes seat outer surface 403 extending from an outer perimeter of the seat top surface 413 to an outer perimeter of the seat bottom surface 414. The seat 401 further includes a seat front end 405 and a seat back end 406. The seat 401 may further include a seat first side (e.g., left side) 404 extending between the seat front end 405 and the seat back end 406 and a seat second side (e.g., right side) 407 opposite the seat first side and extending from the seat front end 405 to the seat back end 406.

Figure 15:
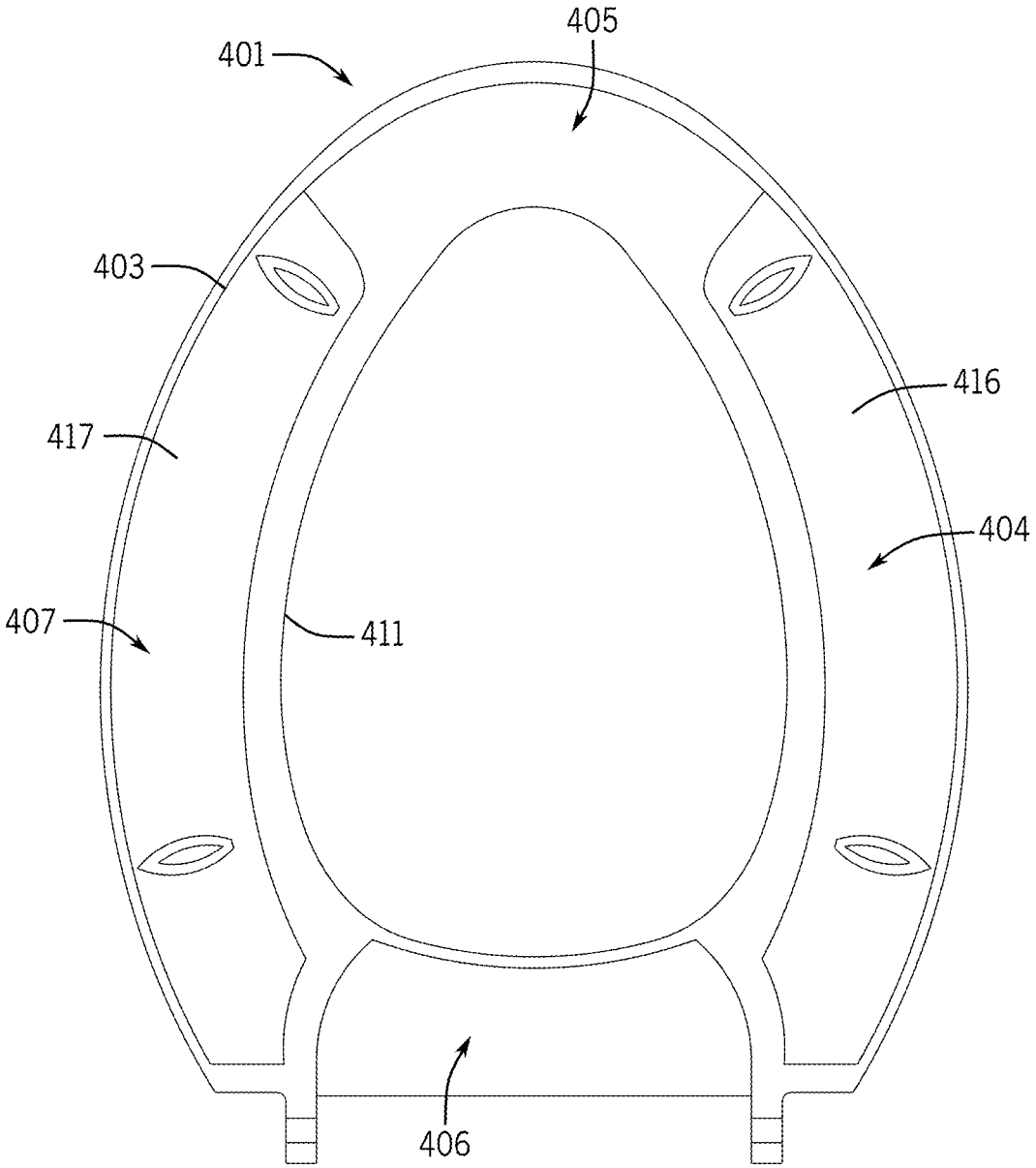
FIG. 15 illustrates a transparent bottom view of a seat according to an exemplary embodiment of the present disclosure.

FIG. 15 illustrates a transparent bottom view of the seat 401 of FIG. 5. As illustrated in FIG. 15, the seat 401 incudes a first cavity 416 formed in a portion of the seat outer surface 403 on the first side 404 of the seat 401 and a second cavity 417 formed in a portion of the seat outer surface 403 on the second side 407 of the seat 401. The first cavity 416 and the second cavity 417 are disposed in the seat outer surface 403 and extend toward the inner edge 411 of the seat 401. The size and shape of the first cavity 416 and the second cavity 417 may vary. For example, a vertical height of the cavity between the top surface 409 and the bottom surface 410 may be larger or smaller. In another example, a length around the seat outer surface 403 in which the first cavity 416 and the second cavity 417 extend may be larger or smaller. In yet another example, the depth and shape of an interior surface of the cavity may vary. The first cavity 416 and second cavity 417 may each be configured to receive a cushion therein. In some embodiments, the seat may have more than two cavities.

Figure 16:
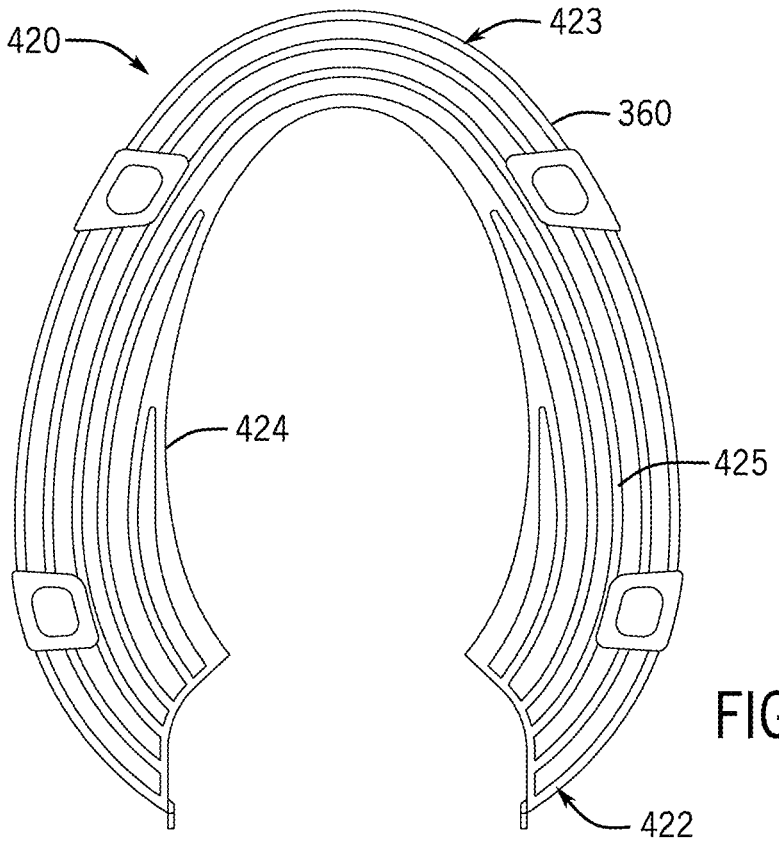
FIG. 16 illustrates a bottom view of a cushion according to an exemplary embodiment of the present disclosure.
Figure 17:
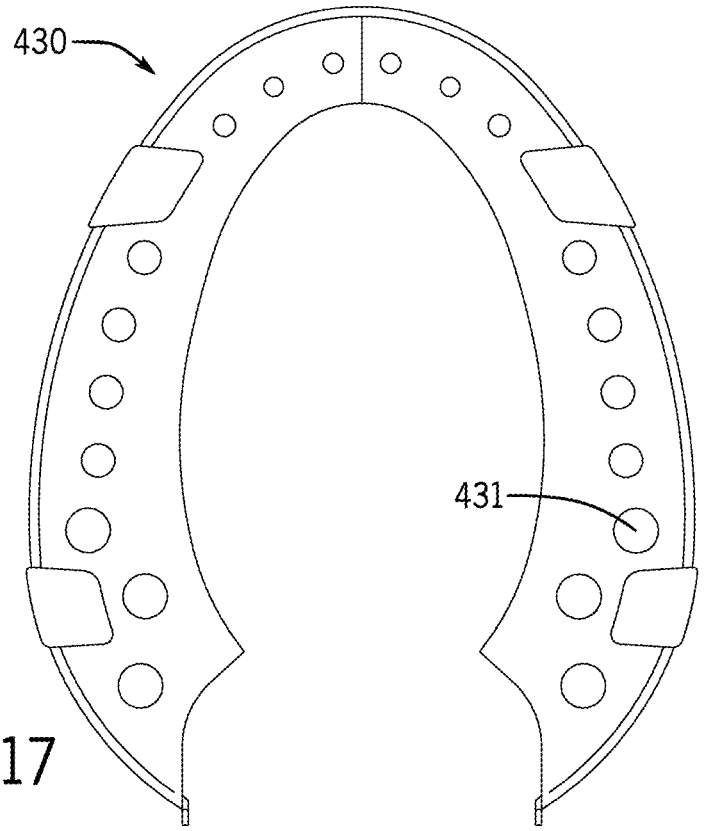
FIG. 17 illustrates a bottom view of a cushion according to an exemplary embodiment of the present disclosure.

Referring generally to FIGS. 16 and 17, in some embodiments, deformation, or flex of the cushion may be controlled or configured using a pattern formed within the cushion. The pattern formed in the cushion may include variations in shape (i.e., a varying profile) and/or variations in material. The pattern may include localized compression zones wherein the profile of a cushion formed of a single material is varied such that a specific region of the profile extends or protrudes vertically away from the rest of the profile. For example, localized pressure zones may include ribs, crush blades, and crush pads formed in a cushion comprised of one material. The pattern may also include variable compression zones, wherein a portion of a profile of a cushion is comprised of a different material than the rest (or a at least a different portion) of the profile. In some examples, variable compression zones may be formed in the profile of the cushion so as not to extend or protrude from the profile. In other embodiments, variable compression may include ribs, crush blades, and crush pads formed of a different material than the rest of the profile. In one example, a variable compression zone in the cushion may include a soft gel or air interior enclosed in a durable soft-shell exterior. Additionally, variable compression zones may take the form of one or more inserts comprising a material different than the cushion, inserted into the cushion. The location of one or more inserts in the cushion 300 may vary. In one example, the one or more inserts may be inserted at a location in the cushion corresponding to a location where a bumper on the bottom surface of the seat contacts an upper rim of a toilet. In some embodiments, two inserts may be installed proximate to the cushion front end and two inserts may be installed proximate to the cushion back end.

FIG. 16 illustrates a cushion 420 according to an exemplary embodiment of the present disclosure. As illustrated, the cushion 420 includes a plurality of ribs 421. The ribs 421 may create a localized compression zone in the cushion 420. Accordingly, each rib 421 is a region along the profile of the cushion 420 that extends vertically away from the rest of the profile. The vertical distance by which the ribs 421 extend away from the rest of the profile of the cushion may vary. The location and size of the ribs 421 may vary. As illustrated in FIG. 16, the ribs 421 generally extend from the cushion back end 422 to the cushion front end 423 and around the cushion front end 423. In other embodiments, the ribs may extend from the cushion inner edge 424 to the cushion outer surface 425.

FIG. 17 illustrates a cushion 430 according to another exemplary embodiment of the present disclosure. The cushion 430 as illustrated in FIG. 17 includes crush pads (i.e., crush zones) 431. Crush pads 431 formed of the same material as the rest of the cushion 430 may create localized compression zones in the cushion 430. Crush pads 431 formed of a material different than the material comprising the rest of the cushion 430 may create variable crush zones in the cushion 430. The vertical distance by which the crush pads 431 extend away from the rest of the profile of the cushion 430 may vary. The number of, size, and shape of the crush pads 431 may vary. As illustrated in FIG. 17, the crush pads 431 are circular. In other embodiments, the crush pads may be any other shape such as rectangular, trapezoidal, and the like.

Figure 18:
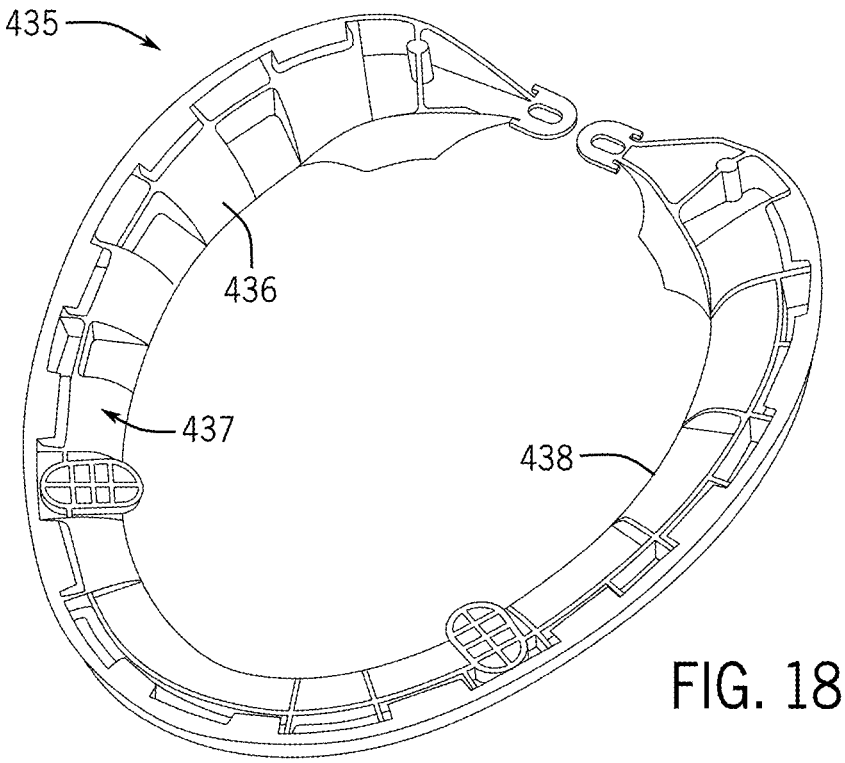
FIG. 18 illustrates a perspective view of a cushion according to an exemplary embodiment of the present disclosure.

Referring to FIG. 18, a cushion 435 including a plurality of compression pads 436 is illustrated. As illustrated in FIG. 18, a plurality of compression pads 436 may be disposed along an interior portion 437 of the cushion 435 disposed adjacent to the interior perimeter 438 of the cushion 435. Each of the plurality of compression pads 436 may be compressed within a cavity of a seat, in response to a force applied to a top surface of the seat. The quantity, size, and material comprising the compression pads 436 may control deformation of a toilet seat assembly including the cushion 435. As illustrated in FIG. 18, the compression pads 436 may be intermittently provide around the insertion portion of the cushion 435.

Figure 19:
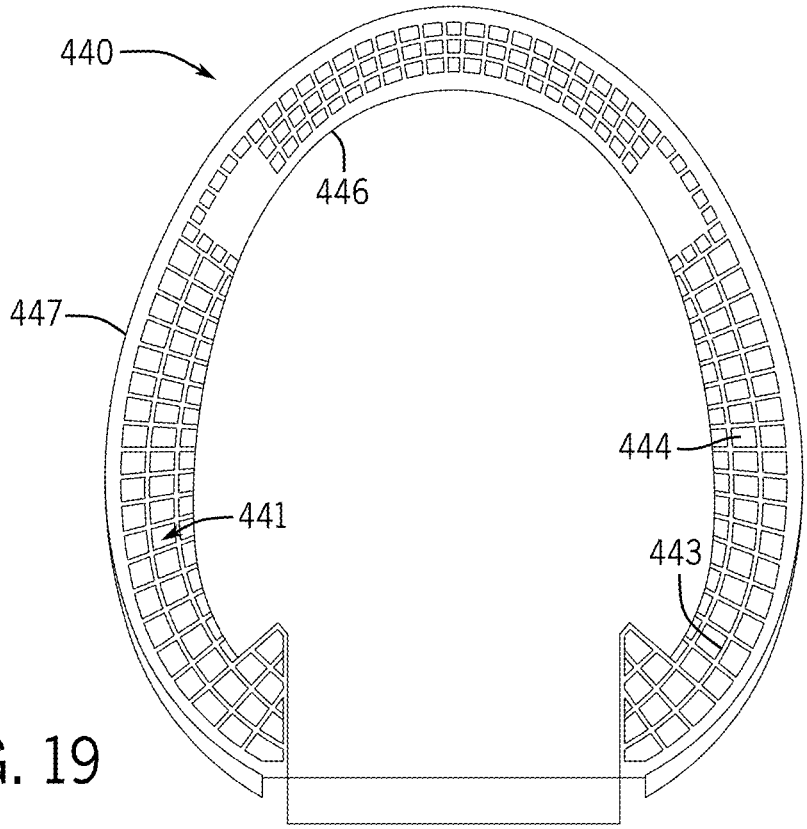
FIG. 19 illustrates a top view of a cushion according to an exemplary embodiment of the present disclosure.

Referring to FIG. 19, a cushion 440 including a compression web 441 is illustrated. As illustrated in FIG. 19, the compression web 441 is comprised of a plurality of partitions 443. The plurality of partitions 443 may intersect forming relatively thin pockets 444 between the plurality of partitions 443. A thickness of the partitions 443 may vary across the cushion 440. For example, the partitions 443 may be relatively thin at a cushion inner edge 446 and may gradually increase in thickness toward a cushion outer edge 447. The cushion 440 may be configured to be disposed within a cavity in a seat. When a load is applied to a top surface of the seat, the plurality of partitions may be configured to be compressed between a cavity top surface and a cavity bottom surface. The cushion may have a spring constant or amount of force required to compress the cushion a predetermined distance between the cavity top surface and the cavity bottom surface. The cushion spring constant may be determined by a material comprising the cushion, a number of partitions 443, a height of the partitions 443, and/or a width of the partitions 443. For example, a spring constant of the cushion 440 may be increased by increasing a durometer of the material comprising the cushion, increasing a quantity of partitions 443 and/or increasing a width of the partitions 443. Conversely, a spring constant of the cushion 440 may be reduced by decreasing a durometer of the material comprising the cushion 440, decreasing a quantity of partitions 443 and/or decreasing a width of the partitions 443.

Figure 20:
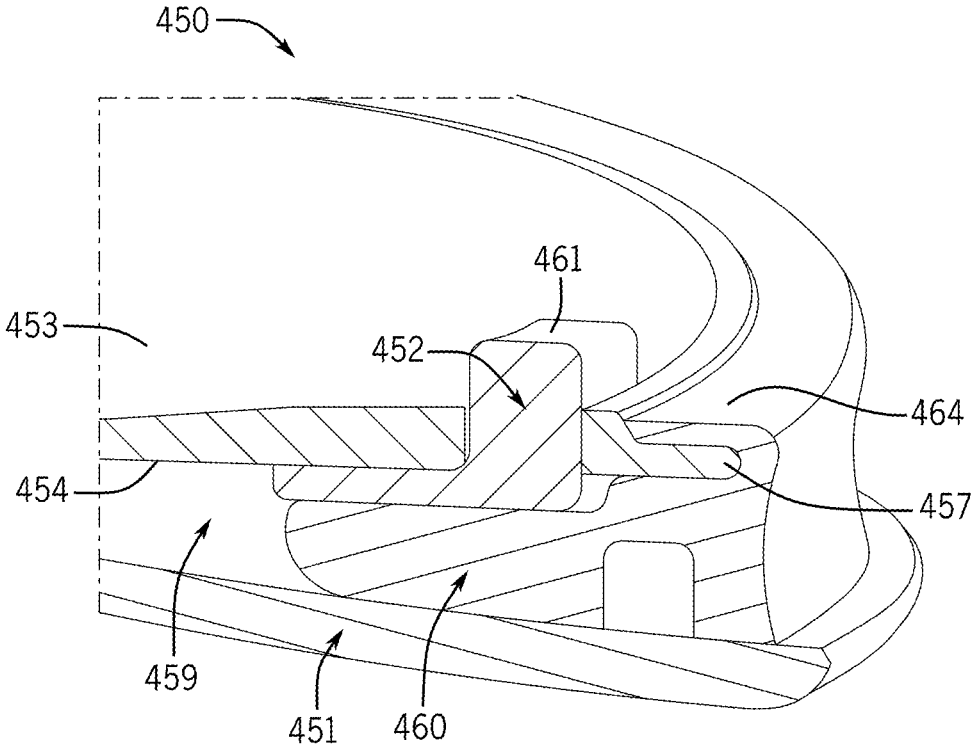
FIG. 20 illustrates a partial cross-section view of a toilet seat assembly according to an exemplary embodiment of the present disclosure.

Referring to FIG. 20 a cross section of a toilet seat assembly 450 including a seat 451 and a cushion 460 according to an exemplary embodiment of the present disclosure is illustrated. As illustrated in FIG. 20, in some examples, the cushion 460 may include an integrated bumper 461 configured to extend through a bumper pocket 452 extending between a seat bottom surface 453 and a cavity bottom surface 454. The integrated bumper 461 and the bumper pocket 452 may couple the cushion 460 to the seat 451 and prevent movement of the cushion 460 relative to the seat 451 at the integrated bumper 461. The bumper pocket 452 and the integrated bumper 461 may have the same shape. The shape of the bumper pocket 452 and the integrated bumper 461 may vary. For example, the bumper pocket 452 and the bumper 461 may have a rectangular shape.

Still referring to FIG. 20, in some examples, the cushion 460 may further include a retaining feature 464. The retaining feature 464 may be configured to extend out of the cavity 459 of the seat 451 and around an outer perimeter 457 of the seat bottom surface 453. In some examples, the integrated bumper 461 and the retaining feature 464 may collectively couple the cushion 460 to the seat 451. Specifically, a portion of the seat 451 may be disposed between the integrated cushion 460 and the retaining feature 464. The integrated bumper 461 and the retaining feature 464 may be used alone or in combination with any other structure for coupling the cushion 460 to the seat 451.

Figure 21:
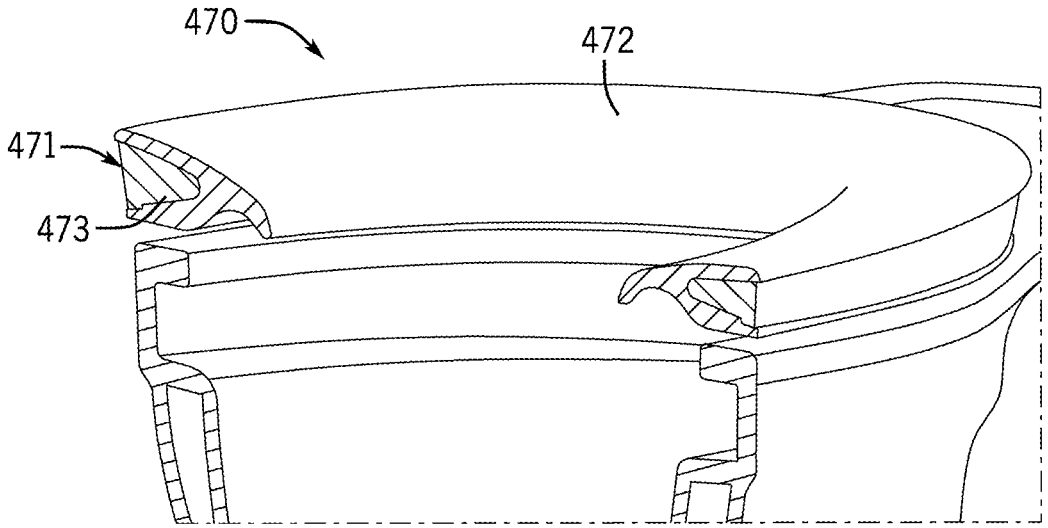
FIG. 21 illustrates a partial cross-section view of a toilet seat assembly according to an exemplary embodiment of the present disclosure.
Figure 22:
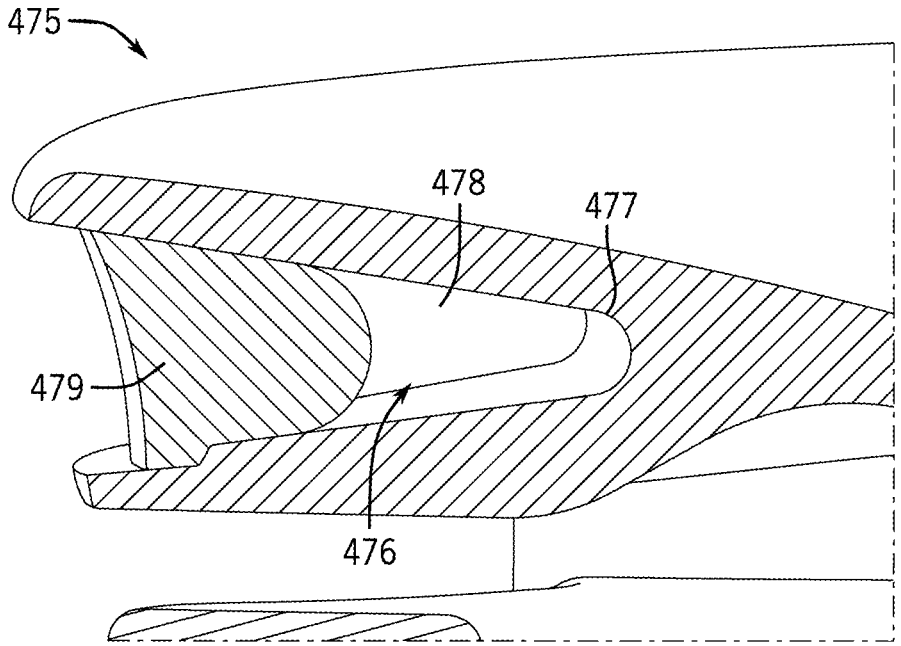
FIG. 22 illustrates a partial cross-section view of a toilet seat assembly according to an exemplary embodiment of the present disclosure.

FIGS. 21 and 22 illustrate cross-section views of toilet seat assemblies according to exemplary embodiments of the present disclosure. Specifically, FIG. 21 illustrates a cross-section view of a toilet seat assembly 470 in which a cavity 471 in a seat 472 is entirely filled by a cushion 473.

In other examples, as illustrated in FIG. 22, a toilet seat assembly 475 may include an air pocket 476 disposed between an interior surface 477 of the cavity 478 and the cushion 479. In some examples, an air pocket 476 may be disposed between an interior surface of the cavity 478 and the cushion 479 to facilitate deformation of the cushion 479. As the cushion 479 is deformed vertically, the cushion may expand horizontally or radially. Providing an air pocket 476 between an interior surface 477 of the cavity 478 may allow the cushion 479 to deform horizontally or radially both inward and outward (i.e., both toward and away from a seat inner edge). The portion of the cavity 478 occupied by the cushion 479 may vary. Additionally, a cross sectional shape of the cushion may vary.

Referring generally to FIGS. 23-37, a plurality of structures for coupling a cushion to a seat are illustrated. Any of the structures illustrated in FIGS. 23-37 and described herein after may be used alone or in combination to couple a cushion to a seat.

Figure 23:
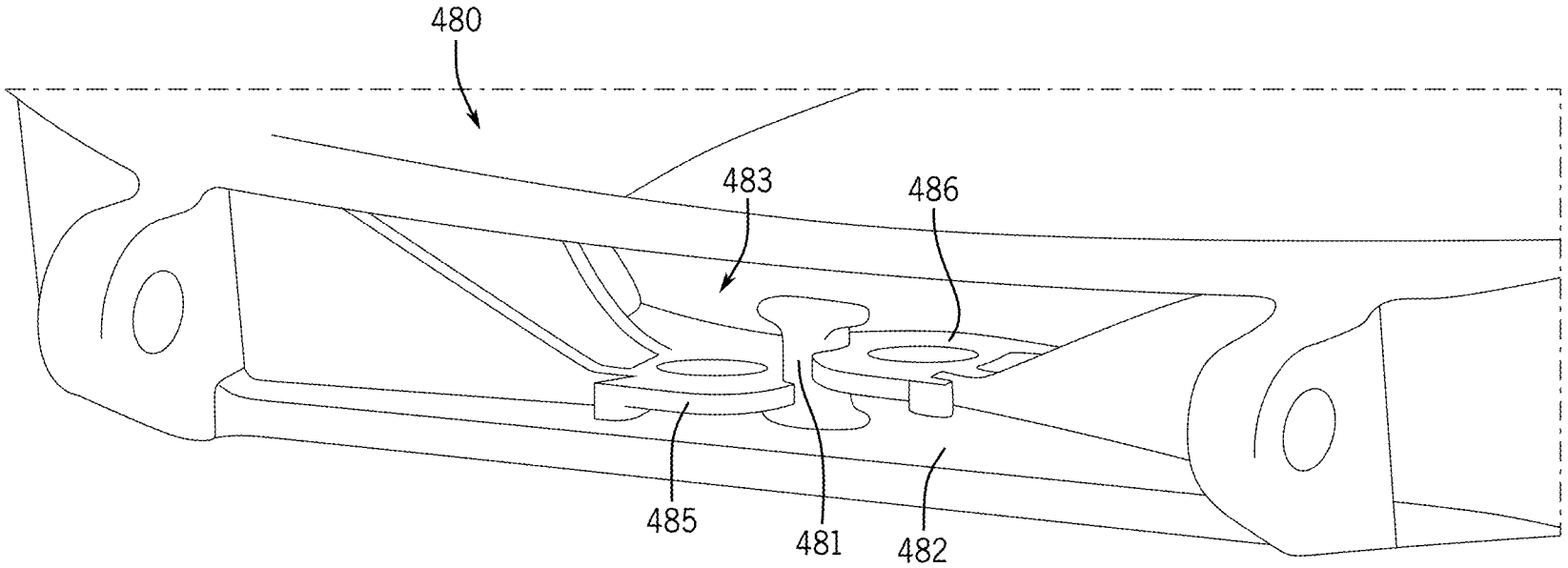
FIG. 23 illustrates a partial perspective view of a seat according to an exemplary embodiment of the present disclosure.

Referring to FIG. 23, a seat 480 including a central locking projection 481 is illustrated. The central locking projection 481 may extend vertically from a cavity bottom surface 482 of a cavity 483 disposed in the seat 480. The central locking projection 481 may extend vertically from the cavity bottom surface 482 at a point along a central axis of the seat 480. The central locking projection 481 may be configured to engage with a locking loop (e.g., locking loop 377) disposed on each end (e.g., 301, 302) of a cushion. Specifically, the central locking projection 481 may be circumscribed by a locking loop disposed on each end of a cushion. The seat 480 may further include a first guide 485 and a second guide 486.

The central locking projection 481 may be configured to be looped or circumscribed by the locking loops one at a time. Specifically, a first locking loop may be looped around the central locking projection 481. When the first locking loop is looped around the central locking projection 481, the first locking loop may be in contact with a top surface of the first guide 485. Next, a second locking loop may be looped around the central locking projection 481. When the second locking loop is looped around the central locking projection 481, the second locking loop may be in contact with a top surface of the second guide 486.

Figure 24:
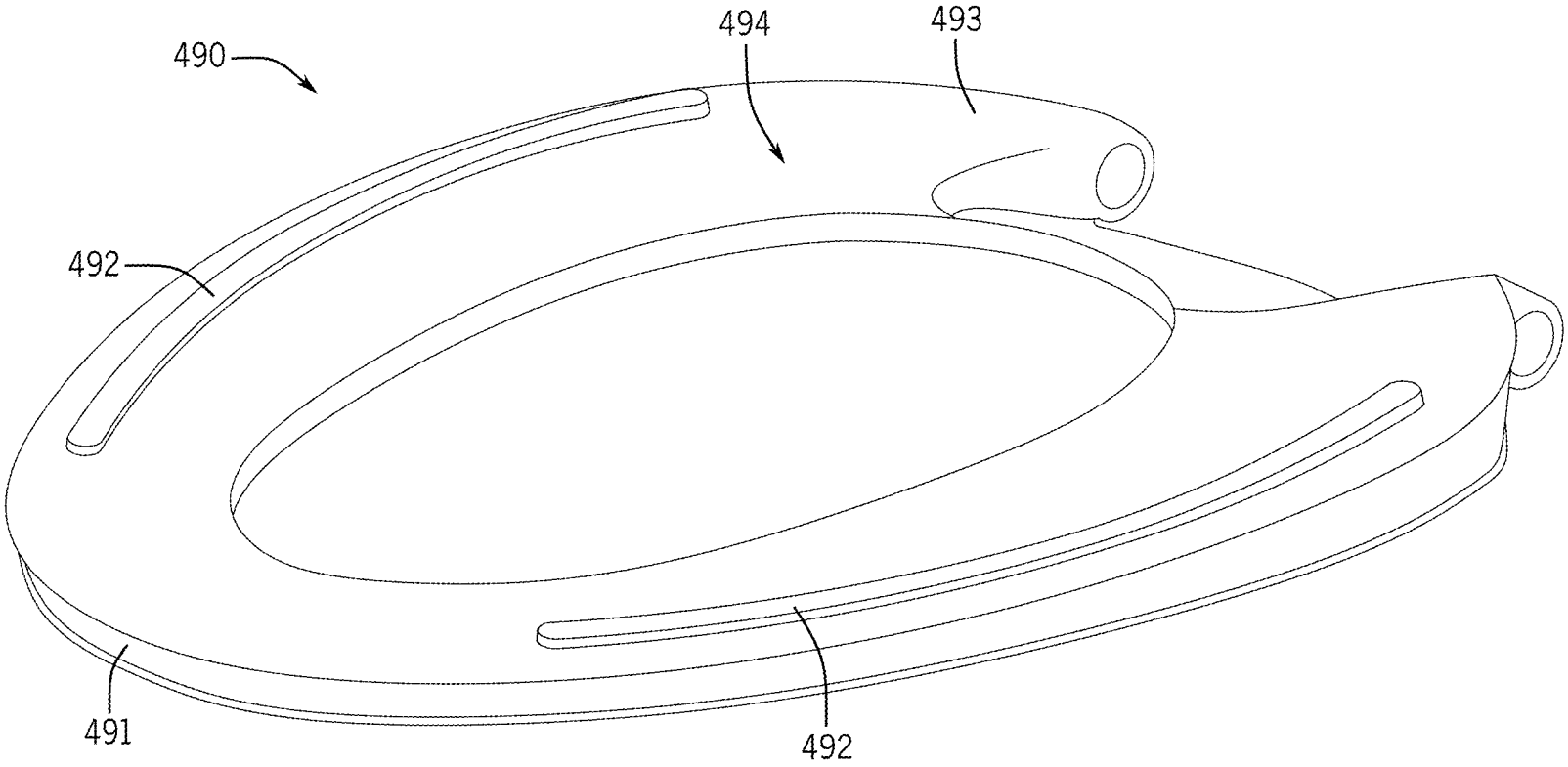
FIG. 24 illustrates a bottom perspective view of a toilet seat assembly according to an exemplary embodiment of the present disclosure.

Referring to FIG. 24, a bottom perspective view of a toilet seat assembly 490 according to an embodiment of the present disclosure is illustrated. In this example, the cushion 491 includes two bumpers 492 (i.e., bumper portions) protruding or extending from a bottom surface of the cushion 491. Each of the bumpers 492 may extend through a bumper pocket extending between the seat bottom surface 493 and a bottom surface of a cavity (e.g., cavity bottom surface) in the seat 494. The bumpers 492 and the bumper pockets may be configured couple the cushion 491 to the seat 494. The number of bumper portions disposed on the cushion 491 bottom surface may vary. In one example, a singular bumper portion 492 may extend or protrude from the cushion 491 bottom surface. In another example, three bumper portions 492 may be disposed on the cushion 491 bottom surface.

Still referring to FIG. 24, the bumpers 492 extend through bumper pocket in the seat 494 between a cavity in the seat and the seat bottom surface 493. The bumper pockets may have a shape corresponding to the bumper portion 492 of the cushion 491 such that the entire bumper pocket is filled when the cushion 491 is disposed in the seat 494. In some embodiments, a single bumper pocket may be formed in the seat 200. In other embodiments, the more than two bumper pockets may be formed in the seat 494. The number of bumper pockets may correspond to a number of bumper portions 492 disposed on the cushion 491 bottom surface. As shown in FIG. 24, when the bumper portions 492 extend through the bumper pockets formed in the seat 494, the cushion 491 may be coupled (e.g., secured) to the seat 494.

Figure 25:
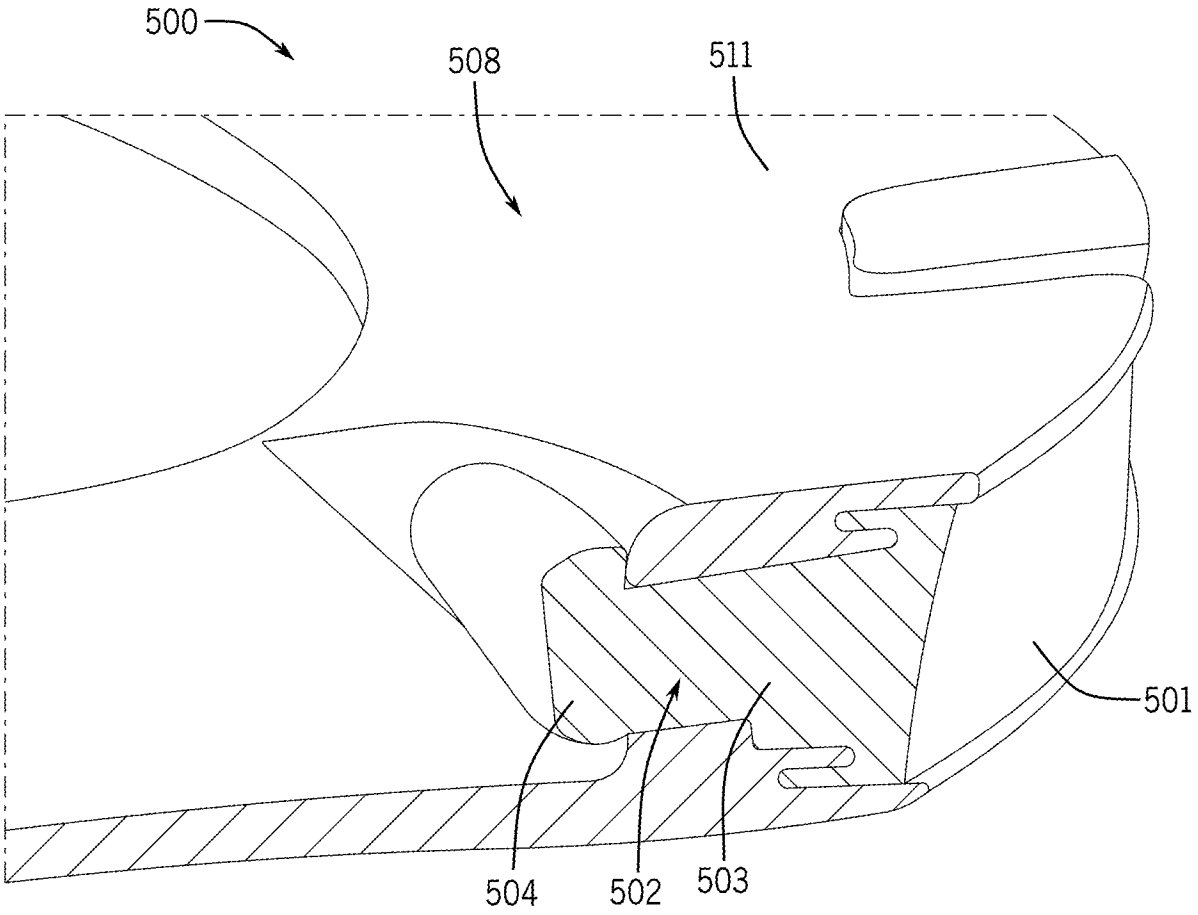
FIG. 25 illustrates a partial cross-section view of a toilet seat assembly according to an exemplary embodiment of the present disclosure.
Figure 26:
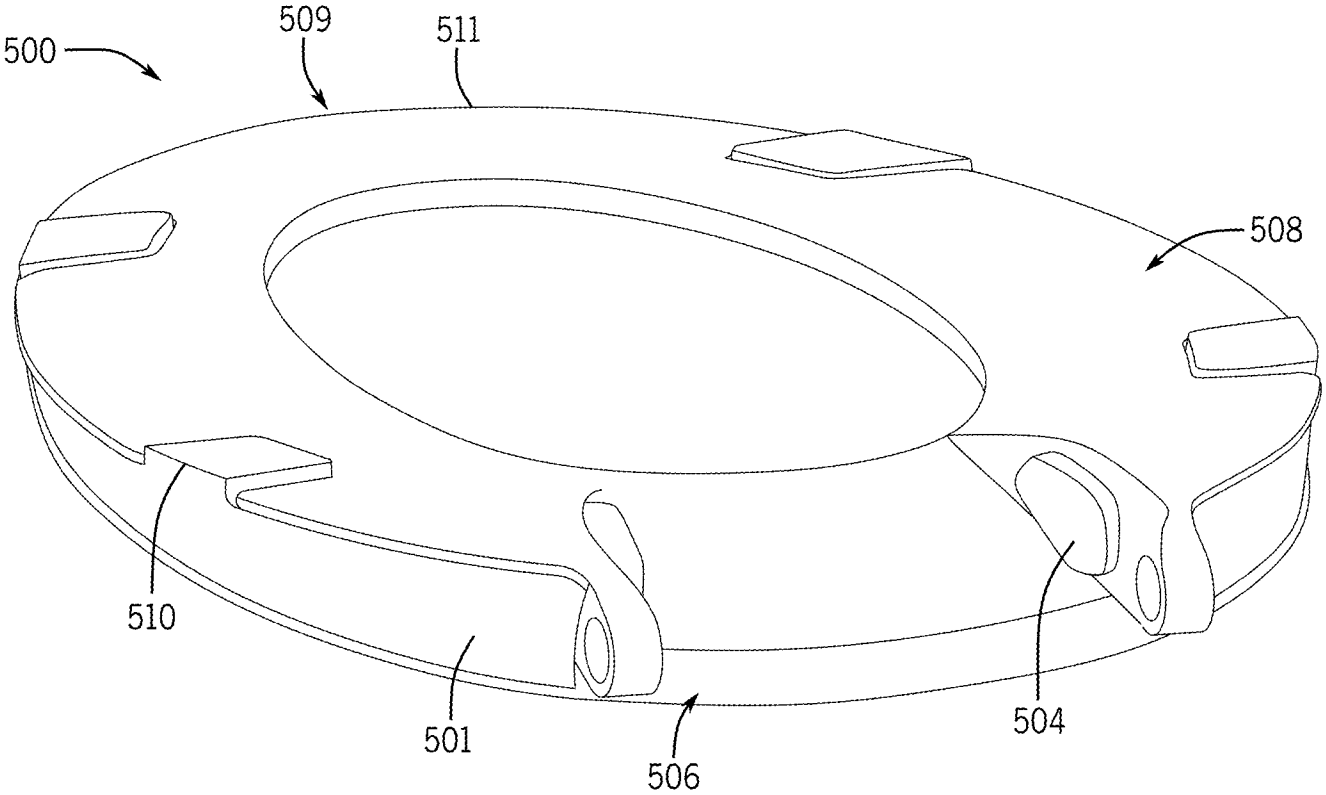
FIG. 26 illustrates a perspective view of a toilet seat assembly according to an exemplary embodiment of the present disclosure.

Referring generally to FIGS. 25 and 26, a toilet seat assembly 500 including a slot lock feature is illustrated. FIG. 25 illustrates a partial cross-section view of a toilet seat assembly 500 including a slot lock feature. In this example, the cushion 501 may have an arcuate shape extending from a cushion first end to a cushion second end. As illustrated in FIG. 25, the cushion 501 includes a hook 502 at each of the cushion first end and the cushion second end. The hook 502 includes a hook narrow portion 503 extending from an end of the cushion 501 between the end of the cushion 501 and the hook flared portion 504. The hook flared portion may have a larger cross-sectional area than the hook narrow portion 503.

As illustrated in FIG. 26, the hook flared portion 504 at a first end of the cushion 501 may be configured to be deformed (e.g., compressed) and inserted through a first slot formed in or near the seat back end 506 and the hook flared portion 504 of the hook at a second end of the cushion 501 may configured to be deformed (e.g., compressed) and inserted through a second slot formed in or near the seat back end 506. The first and second slot formed in the seat may have a shape corresponding to the hook narrow portion 503 and have a cross sectional area smaller than that of the hook flared portions 504. Accordingly, after the hook flared portions have been inserted through their respective openings, the hook flared portions 504 may return to their non-deformed states. The non-deformed states of the hook flared portions may have a larger cross-sectional area than the first and second slots in the seat 508. Accordingly, the cushion 501 may be coupled or secured to the seat 508. In other embodiments, the first slot and the second slot may be disposed at various locations. For example, the first and second slot may be disposed at or near a seat front end 509

Further, in the embodiment of FIGS. 25 and 26, the cushion 501 includes bumper portions 510 that extend through openings formed in the seat 508. As shown, the bumper portions 510 extend from the cavity through the seat bottom surface 511. The seat 508 includes openings corresponding to the shape of the bumpers 510. When the toilet seat assembly of FIGS. 25 and 26 is attached to a toilet, the bumper portions 510 may contact the upper rim of the toilet and prevent the toilet seat assembly from moving (e.g., sliding) relative to the toilet when a user sits on the toilet seat assembly. The bumper portions 510 and their corresponding openings formed in the seat 508 may couple or secure the cushion 501 and the seat 508 to one another.

Figure 27:
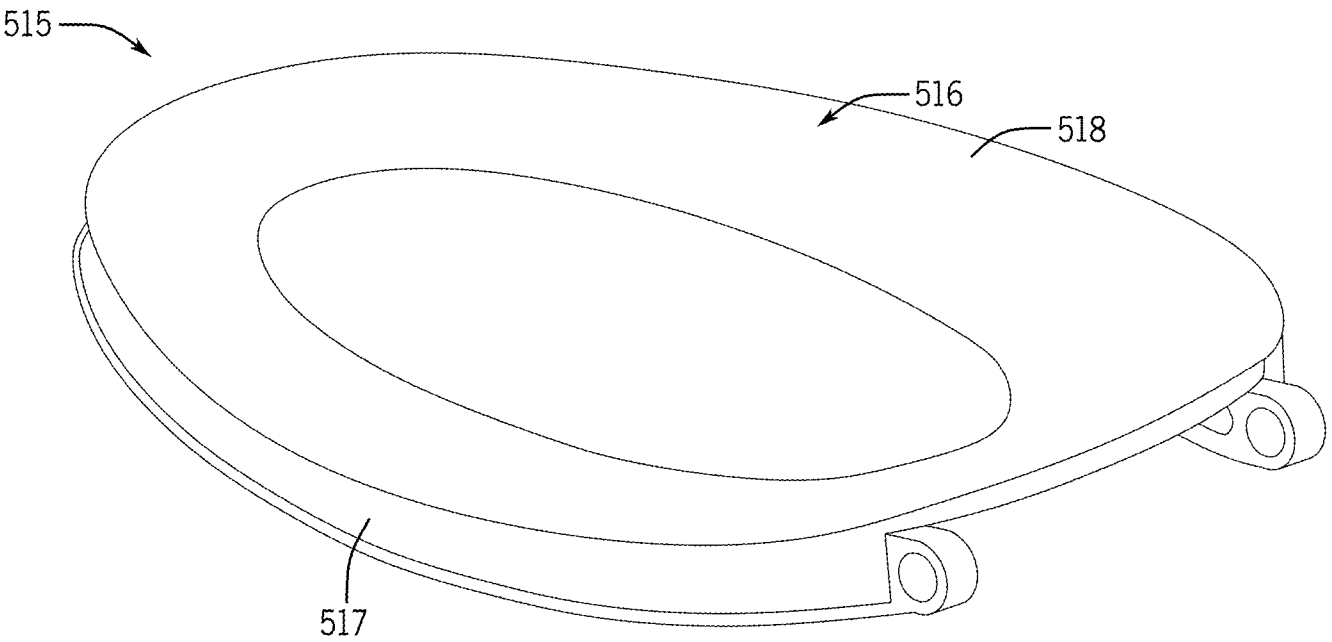
FIG. 27 illustrates a perspective view of a toilet seat assembly according to an exemplary embodiment of the present disclosure.

Referring to FIG. 27, a perspective view of a toilet seat assembly 515 according to an exemplary embodiment of the present disclosure is illustrated. In this example, a cavity formed in the seat 516 extends around the entire outer perimeter of the seat 516. Accordingly, the cushion 517 has an oval shape corresponding to the oval shape of the seat top surface 518 and the seat bottom surface. In this example, the vertical height of the cavity and the cushion 517 varies at different locations around the seat 516 and cushion 517. The cushion 517 may elastically and radially deform (e.g., stretch) from a natural state such that the cushion may be pulled around an outer perimeter of the seat top surface 518 or an outer perimeter of the seat bottom surface and into the cavity securing the cushion 517 within the cavity and coupling the cushion 517 to the seat 516.

Referring generally to FIGS. 28-31, a cushion may include a loop (e.g., a locking loop 377) at each of a first end and a second end of the cushion. The cushion may be configured to elastically deform (e.g., stretch) from a natural state in which no forces are applied to the cushion such that a loop (e.g., locking loop 377) on each of the first end and second end of the cushion loop or circumscribe a first projection (e.g., locking projection 236) and a second projection (e.g., locking projection 236), respectively. In these embodiments, the cushion may be held in tension between the first projection and the second projection.

Figure 28:
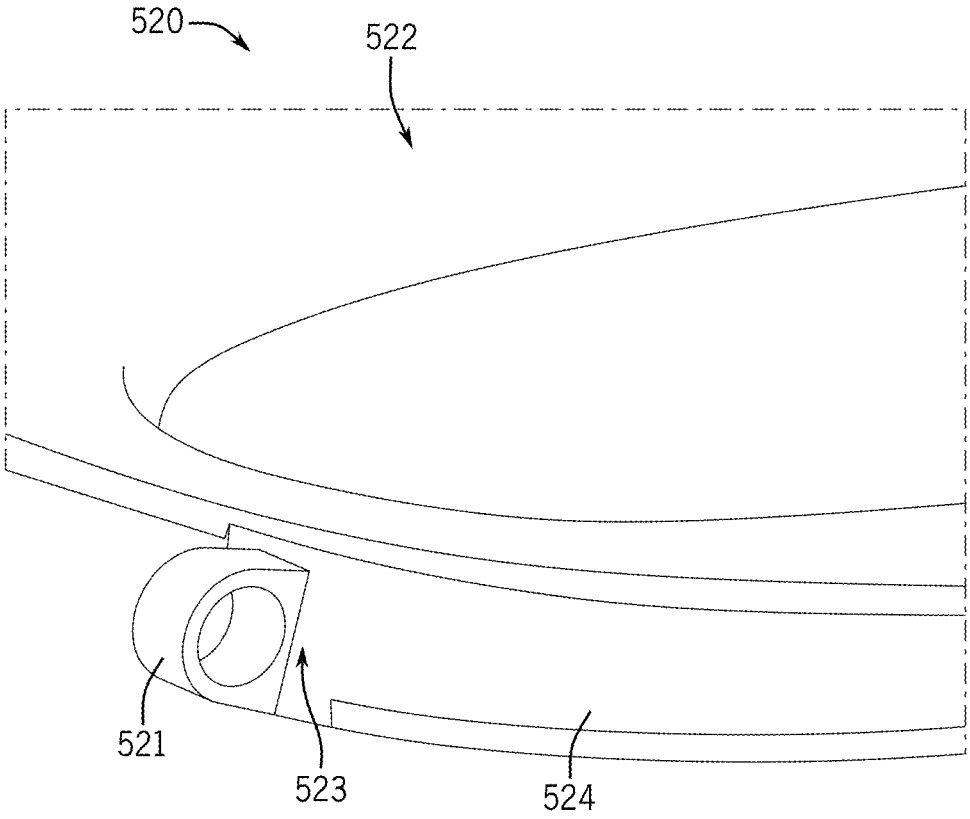
FIG. 28 illustrates a partial perspective view of toilet seat assembly according to an exemplary embodiment of the present disclosure.

Referring to FIG. 28, a partial perspective view of a toilet seat assembly 520 according to an exemplary embodiment of the present disclosure is illustrated. In this example, the first projection 521 may extend or protrude from an outer surface of the seat 522. The first projection 521 may be disposed at or near a back end of the seat 522. The first projection 521 may be offset to first side of a central axis of the seat 522 between a front end and a back end of the seat 522. The seat 522 may include a second projection offset to a second side, opposite the first side of the central axis of the seat 522. In some examples, the first projection 521 and second projection my each include a hole for coupling the toilet seat assembly 150 to a hinge assembly (e.g., a pin of a hinge assembly). The shape and location of the first projection 521 and the second projection may vary.

As illustrated in FIG. 28, a loop (e.g., locking loop 377) in a first end 523 of the cushion 524 may be configured to circumscribe the first projection 521. The loop in the second end of the cushion may be configured to circumscribe a second projection extending from the seat 522. Accordingly, when the loop in the first end 523 of the cushion 524 and the loop in the second end of the cushion 524 circumscribed the first projection 521 and the second projection respectively, the cushion 524 may be coupled or secured to the seat 522.

Figure 29:
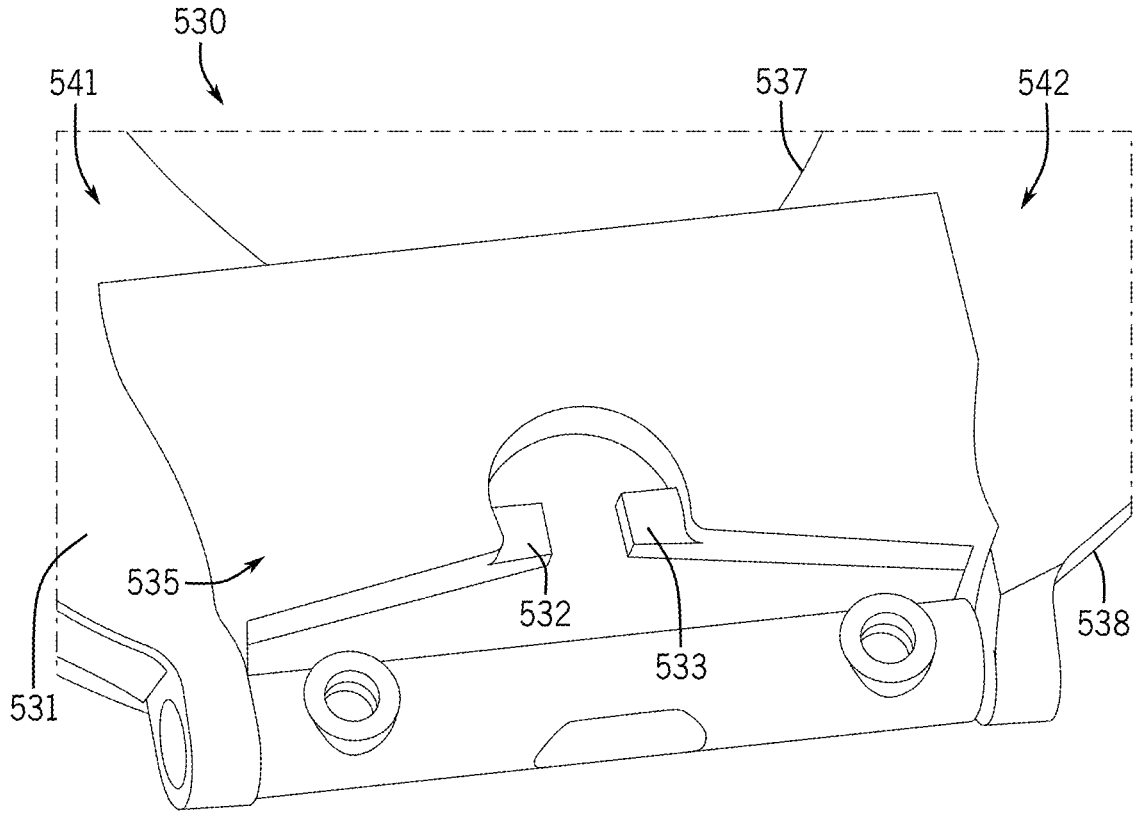
FIG. 29 illustrates a partial bottom view of a seat according to an exemplary embodiment of the present disclosure.
Figure 30:
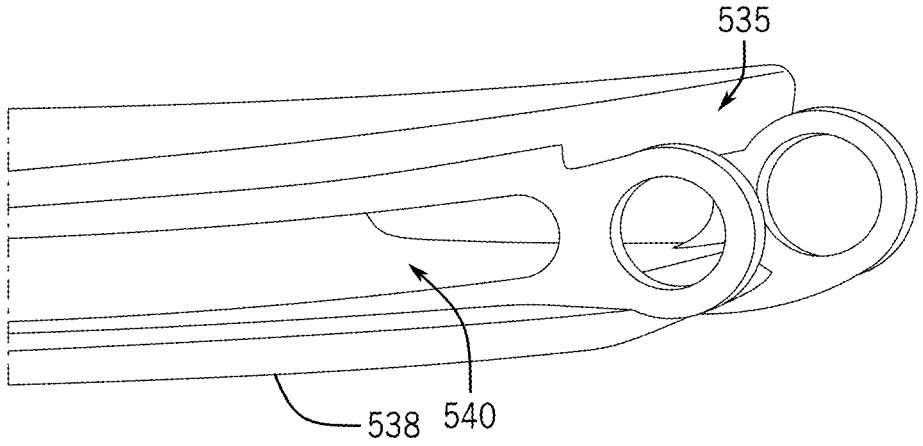
FIG. 30 illustrates a partial perspective view of a seat according to an exemplary embodiment of the present disclosure.
Figure 31:
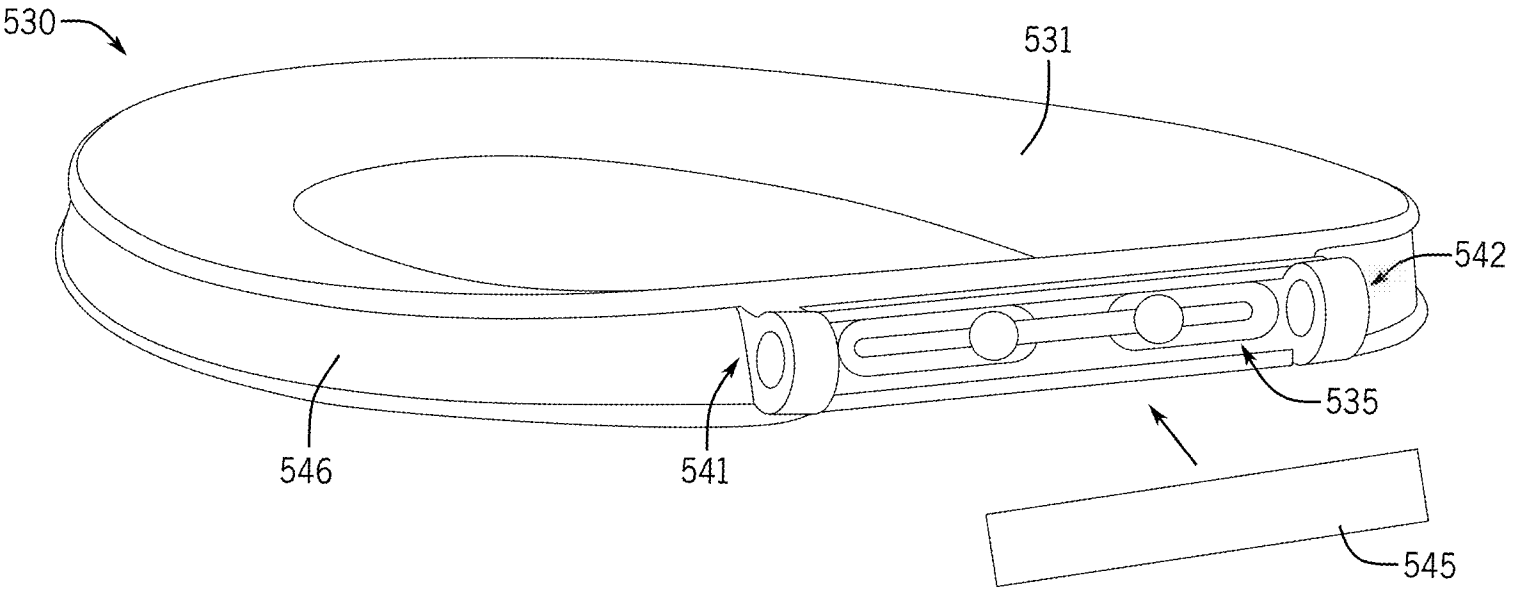
FIG. 31 illustrates a perspective view of a toilet seat assembly according to an exemplary embodiment of the present disclosure.

Referring generally to FIGS. 29-31, a toilet seat assembly 530 according to an exemplary embodiment of the present disclosure is illustrated. Specifically, FIG. 298 illustrates a partial perspective view of the seat 531. In this example, the first projection 532 and the second projection 533 are disposed at or near the seat back end 535. In some examples, as illustrated in FIG. 29, the first projection 532 and the second projection 533 may face one another. In some examples, the first projection 532 and the second projection 533 may be disposed between the seat inner edge 537 and the seat outer surface 538. The size and location of the first projection 532 and the second projection 533 may vary.

Referring to FIG. 30, channels 540 may be formed in the seat back end 535 extending from the seat outer surface 538 to the first projection 532 and the second projection 533, respectively. Referring to FIGS. 29 and 30, a first channel may be formed in the seat outer surface 538 in the seat first side 541 near the seat back end 535 and a second channel may be formed in the seat outer surface 538 in the seat second side 542 near the seat back end 535. The number, size, and location of the channels may vary. Accordingly, when the loop in the cushion first end and the loop in the cushion second end circumscribe the first projection 532 and the second projection 533 respectively, a portion of the cushion proximate to the cushion first end and a portion of the cushion proximate to the cushion second end may be disposed in the first channel and the second channel, respectively.

FIG. 31 illustrates a perspective view of the toilet seat assembly of FIGS. 29 and 30. In this embodiment, the seat 531 may further include a cover 545 that may be removably coupled to the seat back end 535. The cover 545 may be configured to cover a region of the seat 531 between the channel 540 in the seat first side 541 and the channel 540 in the seat second side 542. The cover 545 may be configured to conceal the first projection 532 and the second projection 533 and/or a portion of the cushion 546. In some embodiments, the cover 545 may be comprised of the same material as the seat 531.

Figure 32:
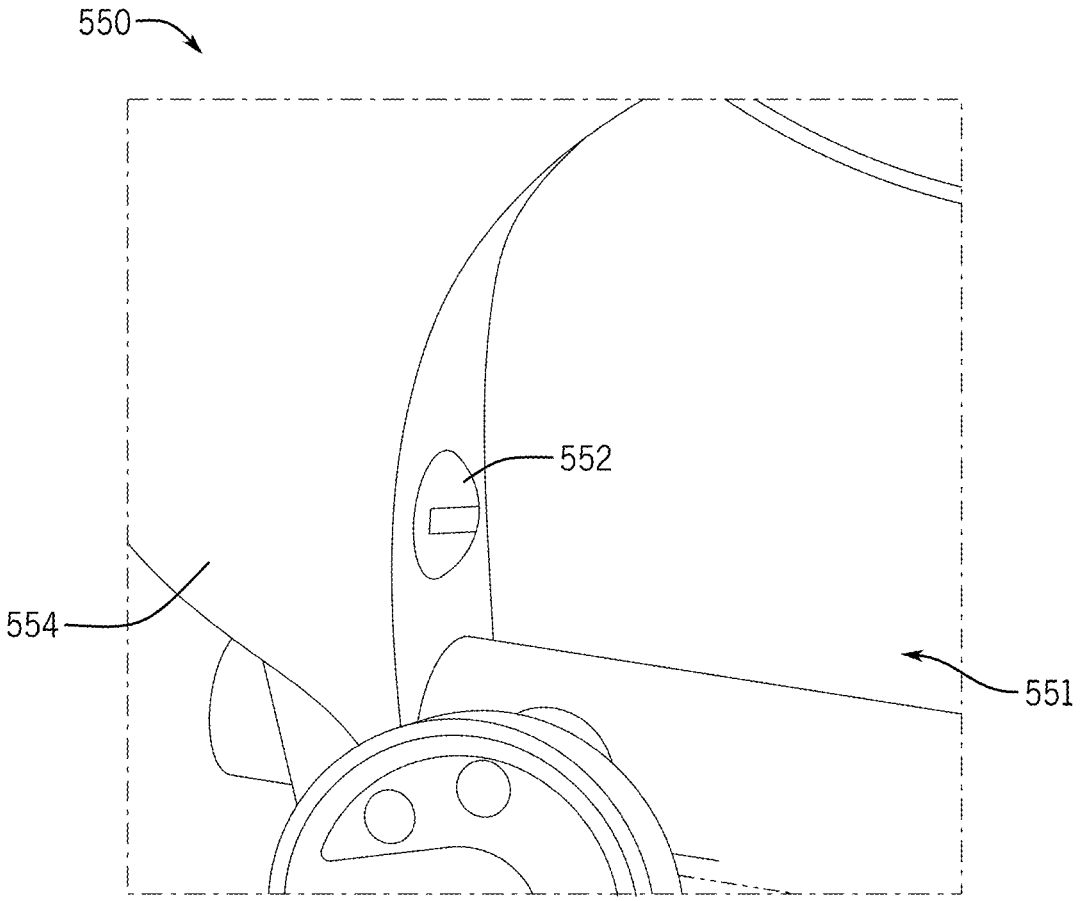
FIG. 32 illustrates a partial bottom view of a seat according to an exemplary embodiment of the present disclosure.

Referring to FIG. 32, a partial perspective view of a toilet seat 550 according to an exemplary embodiment of the present disclosure is illustrated. In this example, the seat 550 further includes a fastener hole in the seat back end 551 and a fastener 552. The fastener 552 may be a nail, screw, bolt, anchor, or the like. The location and number of the fastener holes may vary. For example, the seat 550 may include a fastener hole located in a seat first side and/or the seat second side near the seat back end 551. In another example, four fastener holes may be disposed in the seat bottom surface 554. The fastener 552 may be configured to extend through the fastener hole and into the cushion. The fastener 552 may be configured to couple or secure a cushion to the seat 550.

Figure 33:
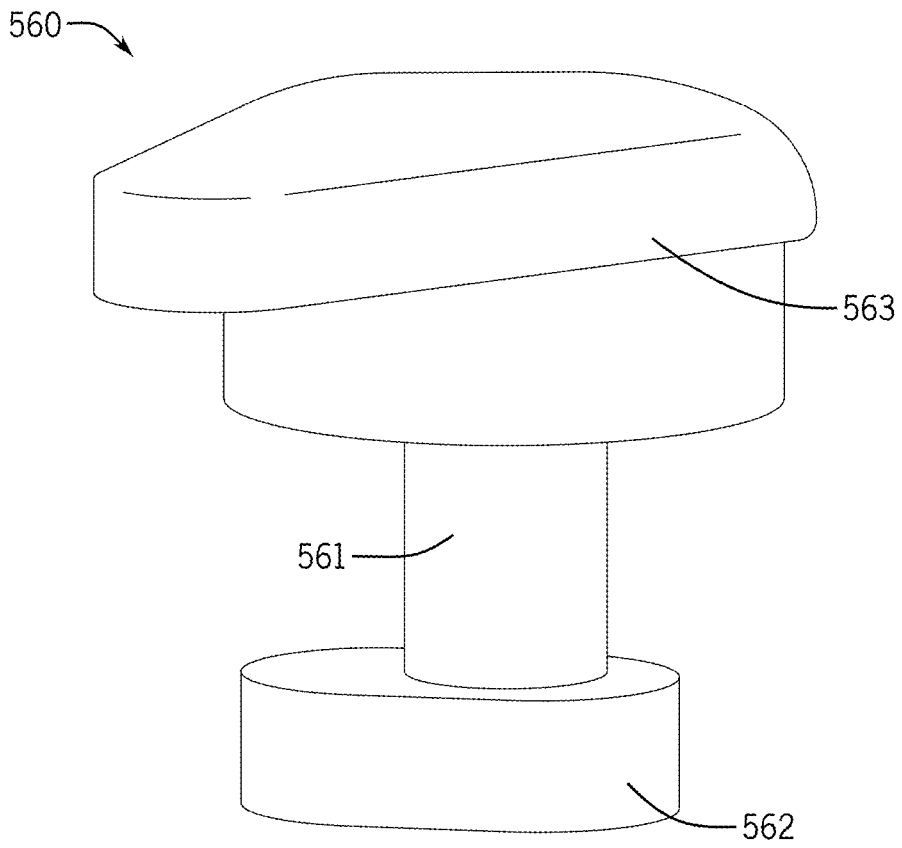
FIG. 33 illustrates a cam lock according to an exemplary embodiment of the present disclosure.
Figure 34:
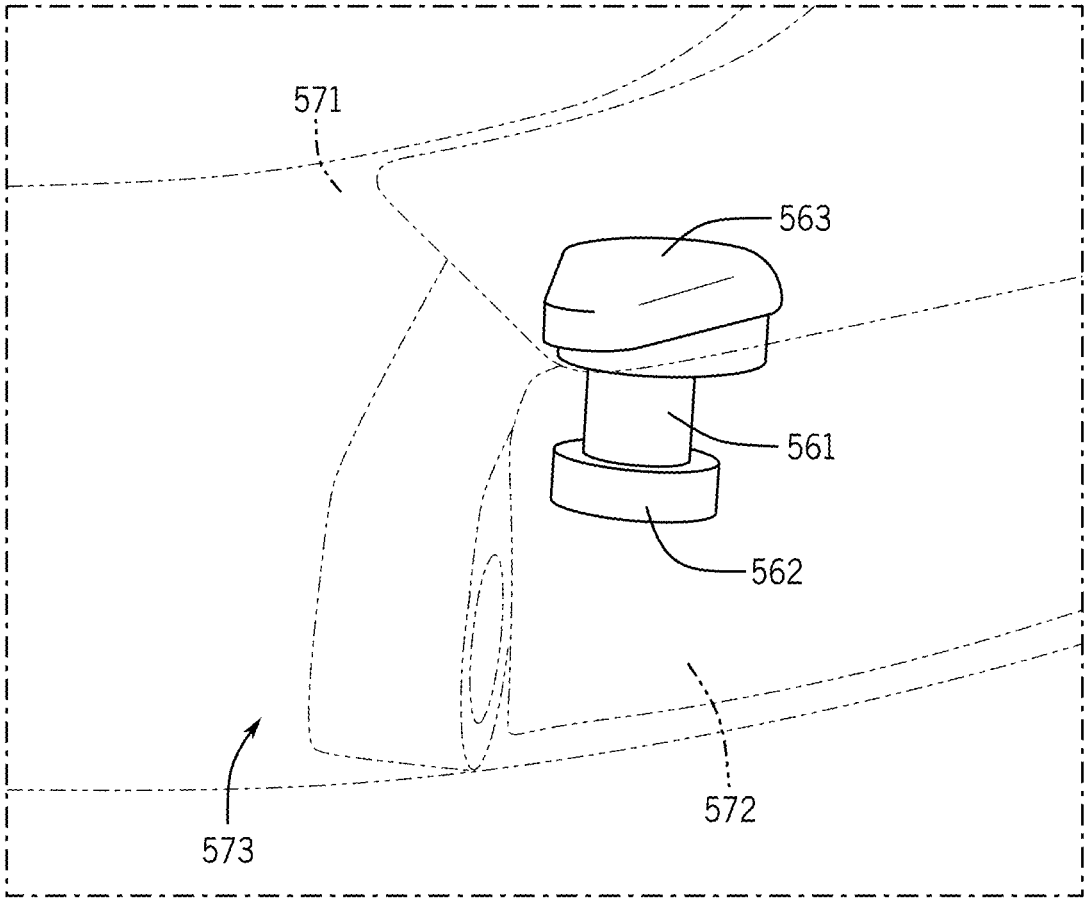
FIG. 34 illustrates a partial perspective view of toilet seat assembly according to an exemplary embodiment of the present disclosure.
Figure 35:
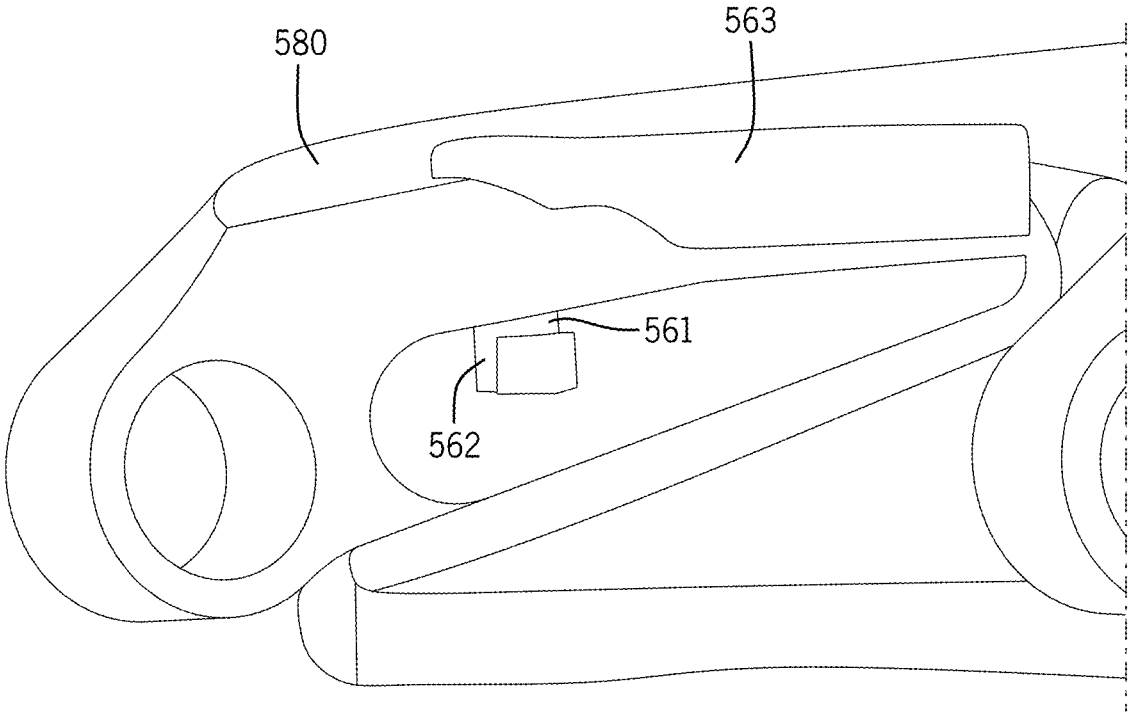
FIG. 35 illustrates a partial perspective view of a toilet seat assembly according to an exemplary embodiment of the present disclosure.

Referring generally to FIGS. 33-35, a toilet seat assembly may include a cam lock for coupling the cushion to the seat. FIG. 33 illustrates a perspective view of a cam lock 560 according to an exemplary embodiment of the present disclosure. The cam lock 560 may have a cylindrical body 561 extending between a cam portion 562 and a lever portion 563. The cam portion 562 and the lever portion 563 may both have an oblong shape. In some examples, the cam portion 562 may be pear shaped. In some examples, the cam lock 560 may be comprised of polypropylene (PP). In other embodiments, the cam lock 560 may be comprised of another material.

FIG. 34 illustrates a toilet seat assembly 570 according to an embodiment of the present disclosure. In this embodiment, the cam lock 560 is inserted through an opening formed in the seat bottom surface 571. When inserted into the opening formed in the seat bottom surface 571 the cam lock 560 may extend into an opening formed in the cushion 572. The shape of the opening in the cushion may vary. For example, in some embodiments, the opening in the cushion 572 may have a circular shape. In another example, the opening may have a rectangular shape. The opening in the cushion 572 may have a circular shape. In some embodiments, a portion of the cylindrical body 561 and the cam portion 562 may extend into the opening formed in the cushion. When disposed in the seat 573 and cushion 572, the cam lock 560 may be configured to rotates about the axis of the cylindrical body 561. The cam lock 560 may be configured such that a user can rotate the cam lock 560 by moving (e.g., rotating, pushing, pulling) the lever portion 563 causing the cam lock 560 to rotate about the axis of the cylindrical body 561. When the cam lock 560 is rotated, the cam portion 562 may impinge on an inner surface of the opening in the cushion such that cushion 572 is held in contact with the seat 573, coupling or securing the cushion 572 to the seat 573.

In some embodiments, the seat assembly 570 may include two or more cam locks 560. The location of the openings in the seat 573 and cushion 572 may vary. In one example, the seat assembly may include two cam locks 560. The seat 573 may include an opening in the seat first side 291 near the seat back end 209 and another opening in the seat second side 296 near the seat back end 209. The location of the openings in the seat 573 may corresponded to the location of openings in the cushion 572, when the cushion 572 is disposed in the seat 573. In another example, the seat assembly 570 may include four cam locks 560.

FIG. 35 illustrates a partial perspective view of a seat 580 according to an embodiment of the present disclosure. In this embodiment, the seat 580 is configured to have a recess formed therein configured to accommodate the lever portion 563 of the cam lock 560. In this embodiment, the cam lock 560 is configured such that when the lever portion 563 of the cam lock is moved to a position in which the cam portion 562 impinges on the cushion 572 such that it is held in contact with the seat 580 (i.e., a locked position), the lever portion 563 is held within the recess formed in the seat 580 by a lip formed on a top surface of the cushion. In other examples, the seat may include one or more detents configured to hold the lever portion such that the cam lock 560 is held in a locked position.

Figure 36:
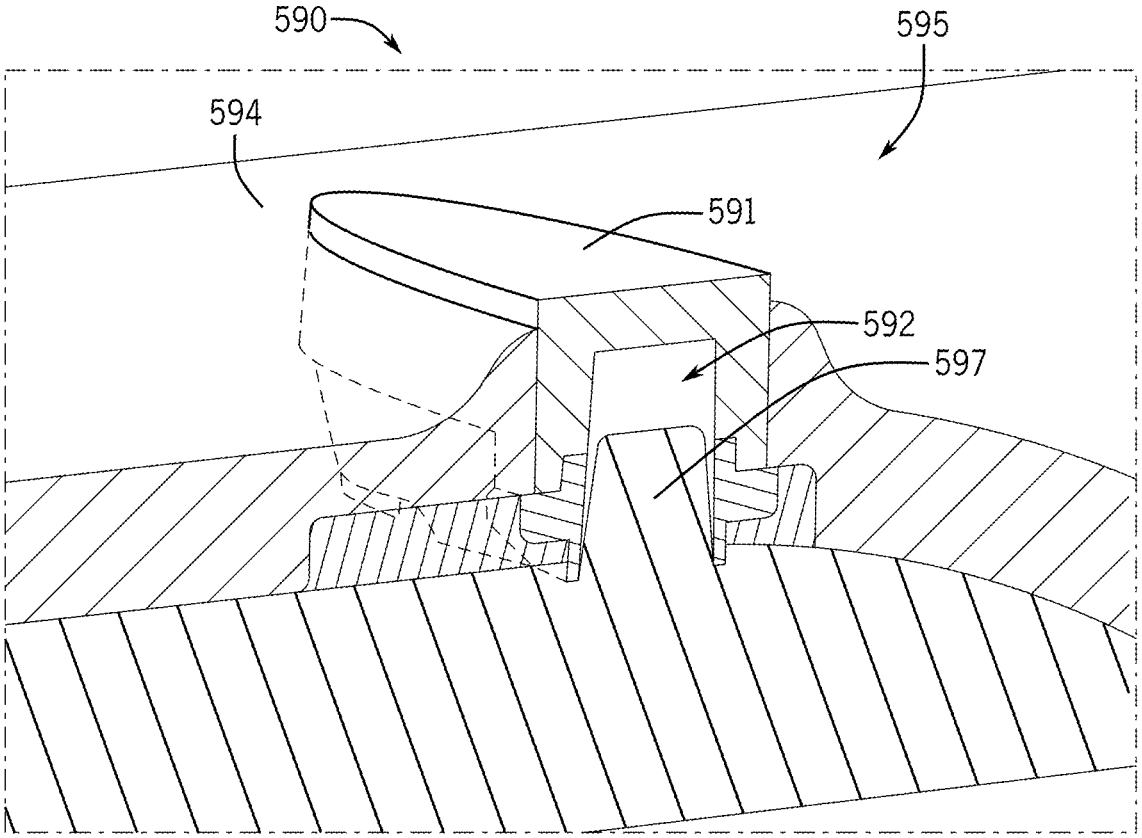
FIG. 36 illustrates a partial perspective view of a toilet seat assembly according to an exemplary embodiment of the present disclosure.

FIG. 36 illustrates a partial cross section view of a toilet seat assembly 590 according to an exemplary embodiment of the present disclosure. In this embodiment, the toilet seat assembly 590 includes a bumper 591 having an internal cavity 592. The bumper 591 is configured to extend through a hole or bumper pocket formed in the bottom surface 594 of the seat 595 such that the internal cavity 592 engages a protrusion 597 formed on the cushion 599, securing the cushion 599 within the internal cavity of the seat 595.

Figure 37:
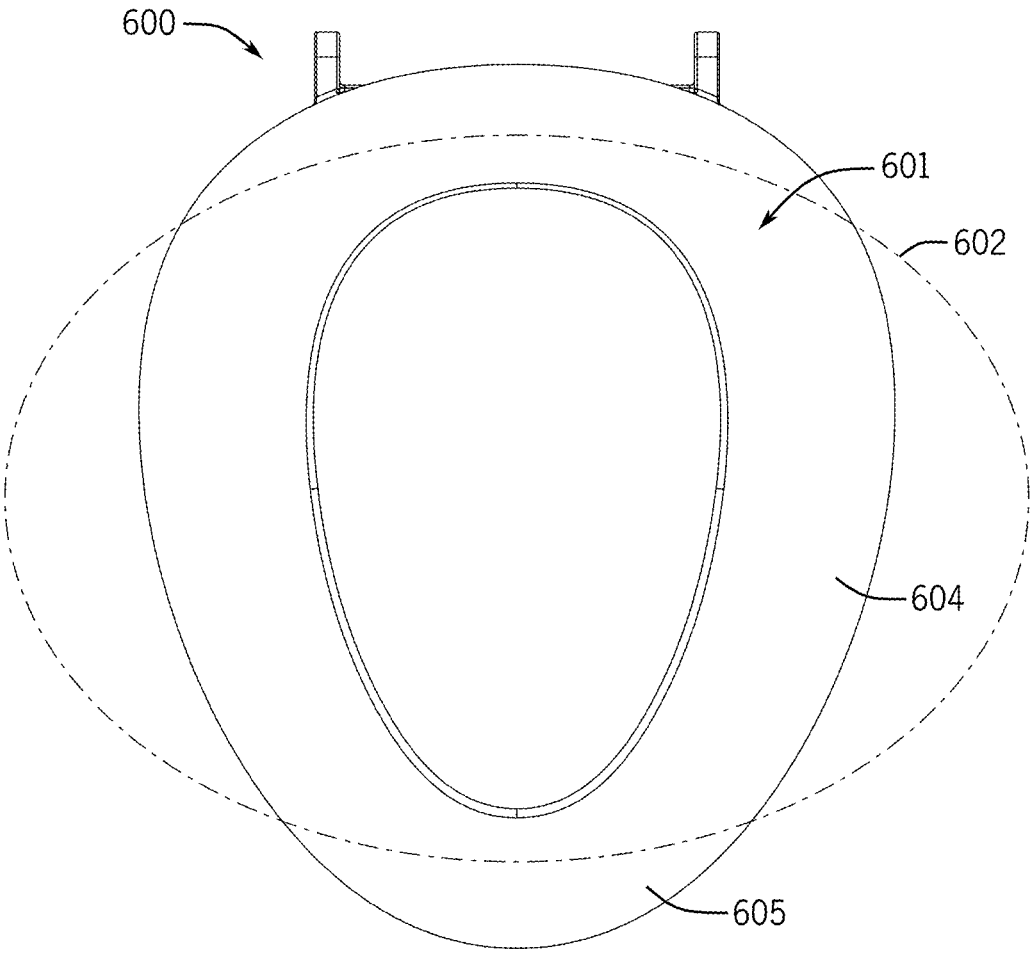
FIG. 37 illustrates a diagram for determining an area of a seat that may be in contact with a user during use of the seat according to an exemplary embodiment of the present disclosure.

Generally, when a user sits on a toilet seat, the user only contacts a portion of the top surface of the seat. Specifically, due to the shape of the human body, a user may not contact a portion of the seat at a front and/or at a back of the seat. Referring to FIG. 37, a diagram illustrating a surface area of a seat top surface 601 on which a user typically sits is illustrated. Referring to FIG. 37, an oval 602 corresponding to a general shape of a user may be overlayed onto of a top view of the seat 600 to determine an area of the seat that is likely to contact a user during use of the seat 600. Specifically, an area 604 of the seat within the oval 602 is likely to contact a user during use and an area 605 of the seat outside the oval 602 is not likely to contact a user.

According to the present disclosure, deformation of the various toilet seat assemblies described herein may provide for an increase in surface area of the seat 600 in contact with a user during use of the seat. Increased surface area in contact with a user may improve weight distribution between the user and the seat and thus improve user comfort during use of the seat 600.

When a component, device, element, or the like of the present disclosure is described as having a purpose or performing an operation, function, or the like, the component, device, or element should be considered herein as being "configured to" meet that purpose or perform that operation or function.

The phrases "coupled with" or "coupled to" include directly connected to or indirectly connected through one or more intermediate components. Additional, different, or fewer components may be provided. Additional, different, or fewer components may be included.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

What is claimed is:

1. A toilet seat comprising:

a top surface;

a bottom surface opposite the top surface;

an inner edge where the top surface and the bottom surface meet;

an outer surface connecting an outer perimeter of the top surface and an outer perimeter of the bottom surface; and a cavity extending from the outer surface toward the inner edge; and wherein the top surface and the cushion are configured to deform elastically and vertically in response to a load applied to the top surface, wherein a shape of the cavity is defined by a cavity interior surface including an inner cavity top surface and an inner cavity bottom surface opposite the inner cavity top surface, and wherein the cushion includes an outer wall extending between the inner cavity top surface and the inner cavity bottom surface, the toilet seat further comprising:

at least one slot disposed in an interior surface of the cavity and extending into the seat; and at least one flange extending radially inward from the outer wall and disposed within the at least one slot.

2. The toilet seat of claim 1, wherein:

a shape of the cavity is defined by a cavity interior surface; and an air pocket is disposed between the cushion and an interior surface of the cavity.

3. The toilet seat of claim 1, wherein:

the at least one slot includes a first slot disposed in the inner cavity top surface and a second slot disposed in the inner cavity bottom surface; and the at least one flange includes a first flange extending radially inward and disposed in the first slot and a second flange extending radially inward and disposed in the second slot.

4. The toilet seat of claim 1, wherein the cushion further comprises:

an inner wall disposed inside the outer wall; and a plurality of bridges extending radially inward from the outer wall connecting the outer wall and the inner wall.

5. The toilet seat of claim 1, further comprising:

a groove disposed in an interior surface of the cavity and extending into the seat; and an exterior flange extending upward and/or radially outward from the outer wall and disposed in the groove.

6. The toilet seat of claim 1, wherein:

the seat further comprises a locking projection; and the cushion further comprises a locking loop circumscribing the locking projection.

7. A toilet comprising:

a bowl;

a toilet seat coupled to the bowl, the toilet seat comprised of a first material, the seat comprising:

a top surface;

a bottom surface opposite the top surface;

an inner edge where the top surface and the bottom surface meet;

an outer surface connecting an outer perimeter of the top surface and an outer perimeter of the bottom surface;

a cavity extending from the outer surface toward the inner edge; and a cushion comprised of a second material different than the first material, the cushion removably coupled to the seat so as to be disposed within the cavity when coupled to the seat.

8. The toilet of claim 7, wherein the top surface and the cushion are configured to deform elastically and vertically in response to a load applied to the top surface.

9. The toilet of claim 7, wherein:

a shape of the cavity is defined by a cavity interior surface; and an air pocket is disposed between the cushion and an interior surface of the cavity.

10. The toilet of claim 7, wherein:

a shape of the cavity is defined by a cavity interior surface including inner cavity top surface and an inner cavity bottom surface opposite the inner cavity top surface; and the cushion includes an outer wall extending between the inner cavity top surface and the inner cavity bottom surface.

11. The toilet of claim 10, further comprising:

at least one slot disposed in an interior surface of the cavity and extending into the seat; and at least one flange extending radially inward from the outer wall and disposed within the at least one slot.

12. The toilet of claim 11, wherein:

the at least one slot includes a first slot disposed in the inner cavity top surface and a second slot disposed in the inner cavity bottom surface; and the at least one flange includes a first flange extending radially inward and disposed in the first slot and a second flange extending radially inward and disposed in the second slot.

13. The toilet of claim 10, wherein the cushion further comprises:

an inner wall disposed inside the outer wall; and a plurality of bridges extending radially inward from the outer wall connecting the outer wall and the inner wall, wherein a height of the inner wall is shorter than a height of the outer wall.

14. The toilet of claim 7, wherein the seat further comprises a locking projection;

the cushion further comprises a locking loop; and the cushion is removably coupled to the seat by stretching the cushion around the seat such that the locking loop circumscribes the locking projection.

15. The toilet of claim 7, wherein:

the first material is one of polypropylene, polyethylene, or polycarbonate; and the second material is a thermoplastic elastomer.

16. A toilet seat assembly comprising:

a seat including a top surface, a bottom surface opposite the top surface, an inner edge where the top surface and the bottom surface meet, an outer surface connecting an outer perimeter of the top surface and an outer perimeter of the bottom surface, and a cavity extending from the outer surface toward the inner edge; and a cushion disposed within the cavity, wherein the seat and the cushion are configured to deform elastically in response to a load applied to the top surface, wherein a shape of the cavity is defined by a cavity interior surface including an inner cavity top surface and an inner cavity bottom surface opposite the inner cavity top surface, wherein the cushion includes an outer wall extending between the inner cavity top surface and the inner cavity bottom surface, and wherein the cushion extends below the inner cavity bottom surface.

* * * * *